US010395482B2

(12) United States Patent
Elias

(10) Patent No.: US 10,395,482 B2
(45) Date of Patent: Aug. 27, 2019

(54) SYSTEMS AND METHODS FOR MODIFYING SELECTIONS AVAILABLE IN A BONUS GAME

(71) Applicant: Gamesys Ltd., London (GB)

(72) Inventor: Hans Elias, Hertfordshire (GB)

(73) Assignee: Gamesys, Ltd., London (GB)

( * ) Notice: Subject to any disclaimer, the term of this patent is extended or adjusted under 35 U.S.C. 154(b) by 458 days.

(21) Appl. No.: 14/216,820

(22) Filed: Mar. 17, 2014

(65) Prior Publication Data

US 2014/0274366 A1 Sep. 18, 2014

Related U.S. Application Data

(60) Provisional application No. 61/801,790, filed on Mar. 15, 2013.

(51) Int. Cl.
*G07F 17/32* (2006.01)
*G07F 17/34* (2006.01)

(52) U.S. Cl.
CPC ..... *G07F 17/3267* (2013.01); *G07F 17/34* (2013.01)

(58) Field of Classification Search
CPC ... G07F 17/3262; G07F 17/3267; G07F 17/34
See application file for complete search history.

(56) References Cited

U.S. PATENT DOCUMENTS 6,015,346 A 1/2000 Bennett
6,159,097 A 12/2000 Gura
6,159,098 A 12/2000 Slomiany et al.
6,315,664 B1 11/2001 Baerlocher et al.
6,322,309 B1 11/2001 Thomas et al.
6,364,766 B1 4/2002 Anderson et al.
6,398,644 B1 6/2002 Perrie et al.
6,607,437 B2 8/2003 Casey et al.
6,783,457 B2 8/2004 Hughs-Baird et al.
6,817,944 B2 11/2004 Kaminkow et al.
6,843,722 B2 1/2005 Webb et al.
6,878,061 B2 4/2005 Baerlocher et al.
6,964,416 B2 11/2005 McClintic et al.
7,040,983 B2 5/2006 Dolloff et al.
7,220,180 B2 5/2007 Kaminkow et al.
7,235,011 B2 6/2007 Randall et al.
7,300,348 B2 11/2007 Kaminkow et al.
7,316,609 B2 1/2008 Dunn et al.
7,347,777 B2 3/2008 Gauselmann
7,351,141 B2 4/2008 Rodgers et al.
7,361,089 B2 4/2008 Daly et al.
7,413,508 B2 8/2008 Nelson et al.
(Continued)

*Primary Examiner* — David Duffy
*Assistant Examiner* — Ankit B Doshi
(74) *Attorney, Agent, or Firm* — Fincham Downs LLC; Magdalena M. Fincham

(57) ABSTRACT

In at least one embodiment, systems, methods and articles of manufacture provide for a game comprising a primary game and a bonus round comprising a plurality of player selectable elements, in which game an outcome of the primary game may include an eliminator symbol which functions to render unavailable for selection at least one of the player selectable elements. In one embodiment, the lowest value player selectable element is removed or rendered unavailable, thus effectively increasing the player's chances of selecting a higher value player selectable element.

19 Claims, 10 Drawing Sheets

(56) References Cited

U.S. PATENT DOCUMENTS 7,530,892 B2 5/2009 Jordan et al.
7,686,685 B2 3/2010 Englman et al.
7,713,122 B2 5/2010 Pacey
7,713,123 B2 * 5/2010 Gerson ..... G07F 17/32 273/139
7,731,579 B2 6/2010 Gomez et al.
7,736,222 B2 6/2010 Casey et al.
7,749,072 B1 7/2010 Singer et al.
7,758,415 B2 7/2010 Kojima
7,780,511 B2 8/2010 Casey et al.
8,038,528 B2 10/2011 Englman et al.
8,070,584 B2 12/2011 Miglbauer
8,221,204 B2 7/2012 Svanas et al.
8,251,798 B2 8/2012 Belger et al.
8,267,764 B1 9/2012 Aoki et al.
8,282,470 B2 10/2012 Englman et al.
8,303,391 B2 11/2012 Englman et al.
8,308,545 B2 11/2012 Gomez et al.
8,382,576 B2 2/2013 Nakamura
8,500,536 B2 8/2013 Watkins et al.
8,523,647 B2 9/2013 McClintic
8,574,053 B1 11/2013 Nelson et al.
8,597,097 B2 12/2013 Hornik et al.
2005/0288093 A1 12/2005 Englman et al.
2006/0079316 A1 4/2006 Flemming et al.
2006/0079317 A1 * 4/2006 Flemming ..... G07F 17/3244 463/25
2006/0281526 A1 12/2006 Hornik et al.
2007/0060268 A1 3/2007 Nelson et al.
2007/0099687 A1 * 5/2007 Gerson ..... G07F 17/32 463/16
2009/0286586 A1 11/2009 Heymann et al.
2009/0318218 A1 * 12/2009 Hornik ..... G07F 17/34 463/20
2011/0009183 A1 1/2011 Yang
2011/0039614 A1 2/2011 Caputo et al.
2011/0111818 A1 5/2011 Baerlocher et al.
2011/0111828 A1 5/2011 Caputo et al.
2013/0035151 A1 2/2013 Owen et al.
2013/0065662 A1 3/2013 Watkins et al.
2013/0102382 A1 4/2013 Barclay et al.
2013/0274011 A1 10/2013 Meyer
2013/0035150 A1 12/2013 Owen et al.

* cited by examiner

SYSTEMS AND METHODS FOR MODIFYING SELECTIONS AVAILABLE IN A BONUS GAME

CLAIM OF PRIORITY

This application claims the benefit of U.S. Provisional Application No. 61/801,790 filed Mar. 15, 2013 in the name of Elias et al., titled SYSTEMS AND METHODS FOR A GAME WHICH PROVIDES FOR REMOVAL OF NEGATIVE OPTIONS OF A BONUS ROUND WHILE PLAYING A PRIMARY GAME. The entirety of this Provisional Application is incorporated by reference herein for all purposes.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

While the invention(s) described herein are susceptible to various modifications and alternative forms, specific embodiments have been shown by way of example in the drawings and will be described in detail herein. It should be understood, however, that the embodiments are not intended to be limited to the particular forms disclosed. Rather, the description provided herein is to cover all modifications, equivalents, and alternatives falling within the spirit and scope of the invention(s) described.

DETAIL DESCRIPTION OF SOME EMBODIMENTS

Figure 1:
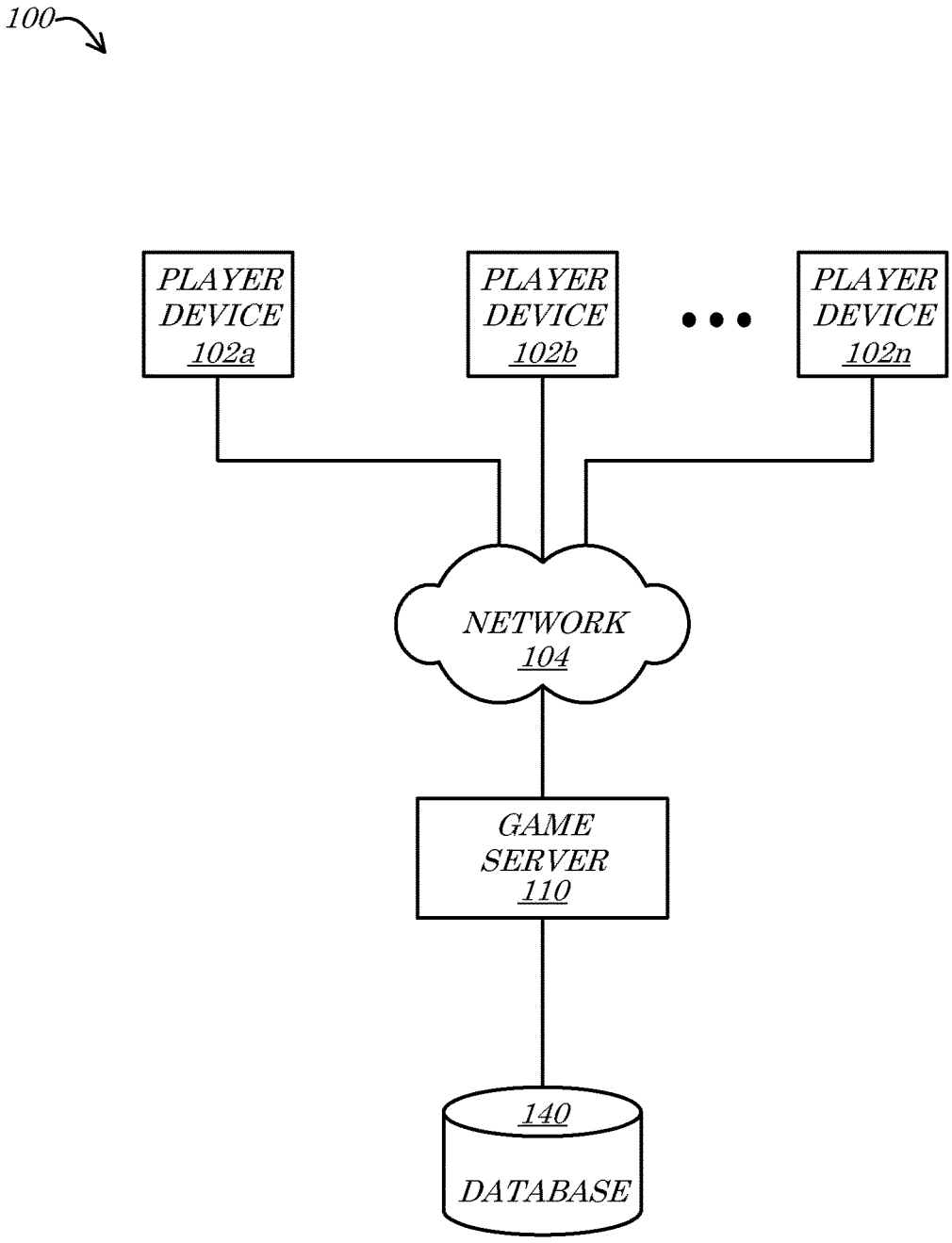
FIG. 1 is a schematic diagram of an embodiment of a gaming system in accordance with one or more embodiments described herein.

Games, whether wagering or non-wagering, are a popular past-time for millions of people all over the world. Electronic games in particular are becoming more and more popular, particularly ones playable online using a computer connected to a network. For example, according to some reports more than 200 million people play social games every month and online games recently passed e-mail as the second-most popular activity online, second only behind social networking. Accordingly, there is a need to continue to create exciting electronic games which maintain players' interest and stand out from the multitude of available online or other electronic games (e.g., games embodied in software and playable on a player device).

In accordance with at least some embodiments, Applicants have developed a game comprising both a primary or first aspect and a bonus round or secondary aspect. In the game, some events which occur in the primary aspect of the game function to modify the choices or selections available to the player during the bonus round once the bonus round is triggered. In one particular embodiment, special symbols referred to as eliminator symbols may be won by a player during the primary aspect of the game and function to eliminate sub-optimal choices which would have otherwise been made available to the player during the bonus round.

As would be understood by one of ordinary skill in the art, a "pick bonus" type of game in which a player is provided with a plurality of player selectable elements. In some types of pick bonus types of games, a characteristic of the player selectable element available in the game is initially hidden or concealed from the player when the player selectable elements are first output to the player for selection. For example, in embodiments in which each player selectable element represents a monetary value or other prize, such monetary value or other prize may be initially hidden from the player. In another example, if the player selectable elements represent respective answers to a riddle, trivia question or other inquiry, the answers represented by the player selectable elements may be initially hidden from the player. In some pick bonus types of games, once a player selects a player selectable element, the characteristic which was previously hidden is revealed to the player (in some embodiments the characteristic may be revealed at the end of the bonus round even for player selectable elements not selected by the player, to show the player the available selections the player did not select).

Applicants have developed a game in which the plurality of player selectable elements which would otherwise be output to the player during a bonus round are refined (e.g., the number of player selectable elements is reduced) based on outcomes achieved or won (in the case of a wagering game) by the player in the primary game. In one embodiment, one player selectable element is removed from the plurality of player selectable elements which are to be output to the player in the bonus round for each eliminator symbol collected or won by the player during the primary game. A player selectable element which is so removed from a plurality of player selectable elements is referred to herein as an eliminated player selectable element. In accordance with at least some embodiments, at least one player selectable element of the plurality of player selectable elements to be made available to the player in the bonus round is a sub-optimal choice. For example, the value represented by the player selectable element is a lower value than at least one other value represented by a different player selectable element. In another example, the answer represented by the player selected element is an incorrect answer to a riddle, trivia question or other inquiry. In accordance with some embodiments, the player selectable element which is removed from the plurality of player selectable elements (i.e., the player selectable element determined to be the eliminated player selectable element) is one that is considered to be a sub-optimal choice.

In accordance with some embodiments, at least the primary aspect of the game is represented as a reeled slot machine. Various "reel-type" or reeled slot machine games are popular with many players, whether deployed on dedicated gaming devices (e.g., a traditional slot machine device in a casino, operable primarily to facilitate one or more slot machine games) or on non-dedicated computing devices (e.g., personal computers, mobile devices, laptops or table computers, which are operable to perform a variety of functions in addition to supporting reeled slot machine games). A reeled slot machine game typically includes a plurality of reels, each reel including a plurality of symbol positions for display of a reel symbol. In accordance with some embodiments, the primary aspect of the game may be represented as a reeled slot machine game. However, the invention(s) described herein are not limited to being implemented in a game in which the primary aspect of the game is a reeled slot machine game.

A "symbol" or "game symbol" is a visual representation of an element or indicia used in the game to indicate an outcome or result in the game (e.g., used to indicate at least one of whether the player has qualified for an award, qualified to enter a bonus round, and qualified for an advantage in the bonus round. A reel symbol is a symbol output on a reel of a game interface. The term "symbol" as used herein may refer to a reeled symbol or a symbol of another type of game that is not a reel-type slot machine game (e.g., a game consisting of a grid, such as a bingo game, a representation of a card in a video poker game or any other type of interface that may be applied to embodiments described herein). A reel may be mechanical (e.g., in a physical dedicated gaming device on a casino floor) or virtual (e.g., a software representation of a reel on an electronic display of a dedicated or non-dedicated device). In a reel-type slot machine game the reels spin (or representations of virtual reels are made to look as if they spin) after a player places a wager on the game, provides another qualifying input or another reel-initiation event occurs. The reels then stop to display generated combinations of symbols on the reels.

It should be noted that embodiments described herein are not limited to reel-type slot machine games. For example, the embodiments may be implemented in a card game (e.g., a multi-hand video poker game), a grid type game (e.g., a bingo or keno game) or any type of game in which events in a primary game may be utilized to refine player selectable elements available to a player in a bonus round of the game. Thus, it should be noted that although the term "spin" is used to refer to a game event which results in an outcome, the term "spin" is intended to encompass any type of game event (not limited to a game event in a reel-type slot machine game) for which an outcome may be determined.

An "element" of a game, as the term is used herein, is a component, constituent or part of a game which is discernable from another component, constituent or part of the game. In some embodiments, an element of a game may be represented as a symbol or indicia of the game. For example, in accordance with some embodiments a bonus round comprises an interface which includes a plurality of player selectable elements. In one embodiment, each such player selectable element is represented by a respective symbol. In one embodiment, each such player selectable element is associated with a respective value. In one embodiment, at least one such player selectable element is associated with a prize which is provided to the player if the player selects that at least one player selectable element.

The "outcome" of a spin or other type of game event, as the term is used herein, is the set of symbols as displayed in a set of symbol positions which are evaluated to determine whether the spin results in an award or prize. In a reel-type slot machine game, an outcome of a spin may refer to the symbols displayed along symbol positions comprising one or more paylines of the game. If a generated symbol or combination of symbols is a winning symbol or combination of symbols (i.e., a symbol or combination of symbols associated with an award), the award corresponding to the winning symbol or winning symbol combination is provided or output. The symbols along a payline at the end of a spin (i.e., once the reels are stopped and the symbols in the symbol positions are positioned such that a player may determine whether he/she qualifies for an award as a result of the spin) are referred to as the "outcome of the payline" herein.

In accordance with one or more embodiments, a game (e.g., a game embodied in software and playable on a player device) comprises a primary game and a bonus round. During the bonus round, which may be triggered once a player achieves a qualifying event while playing a primary game, a player is provided with available choices or elements, at least one of which (if selected by the player during the bonus round) is revealed to be a choice or element associated with a prize (e.g., a number of credits to be added to a credit balance of a player or another benefit). In some embodiments, the player selectable elements may comprise a plurality of player selectable elements in each of a plurality of categories, such that to qualify for the prize the player must select, for each category, the at least one player selectable element which is associated with the prize. For example, in a CLUE™-themed game, a player may be provided with a plurality of categories relevant to solving a mystery or crime, such as (1) who did it?, (2) with what weapon? and (3) in which room? Each category may include a plurality of respective player selectable elements (e.g., a plurality of possible suspects who committed the crime, a plurality of possible weapons which may have been used to commit the crime, and a plurality of possible rooms in which the crime occurred). In accordance with some embodiments, there may only be one "correct" answer, or one combination of choices (e.g., one from each category) which, if selected by the player, qualifies the player for a prize. In accordance with some embodiments, the player may have a predetermined or maximum number of attempts or time in which to select or otherwise determine the correct combination of player selectable elements among the plurality of categories. If, at the end of the predetermined or maximum number of attempts or time, the player has not selected or otherwise determined the correct combination of player selectable elements, the bonus round ends unsuccessfully for the player. Accordingly, it is reasonable to assume that the fewer the number of player selectable elements in each category of player selectable elements, the more likely the player is to win the prize.

In accordance with some embodiments, outcomes of the primary game may impact the number of player selectable elements (e.g., in one or more categories of player selectable elements) available to a player once the player enters a bonus round of the game. In one particular embodiment an outcome in a primary game may include at least one eliminator symbol, the function of which is to remove or otherwise render unavailable at least one player selectable element from a set of player selectable elements of a bonus round. For example, in one embodiment each eliminator symbol collected during the primary game causes one player selectable element of the bonus round to be removed or otherwise rendered unavailable for selection.

In one embodiment, rather than causing a removal of a player selectable element of a plurality of player selectable elements (or otherwise causing a player selectable element previously generated for a bonus round to be rendered unavailable for selection), an eliminator symbol may cause fewer player selectable elements to be generated, identified or determined for a bonus round. This may be implemented in an embodiment in which the player selectable elements for a bonus round are generated, selected or identified by the system upon a player qualifying for the bonus round (i.e., an embodiment in which the player selectable elements for a bonus round had not previously been generated, determined or identified). For example, assuming a bonus round by default includes X player selectable elements, if upon a bonus round being triggered it is determined that a player collected one (1) eliminator symbol during play of the primary game, only (X−1) player selectable elements may be generated, selected, identified or otherwise determined for that bonus round.

Player selectable elements of a bonus round which are removed or otherwise rendered unavailable for player selection (e.g., as a result of an eliminator symbol having been collected during the primary game) are referred to as "eliminated elements" herein. If an eliminated element is represented via a bonus round symbol, the eliminated element may be referred to as an "eliminated symbol" herein.

In one embodiment, a process of facilitating a bonus round may include identifying or determining which player selectable element of a plurality of previously determined player selectable element should be removed or otherwise rendered unavailable for selection based on an eliminator symbol having been collected during play of the primary game (e.g., identifying, selecting or determining a symbol to be eliminated, thus choosing the eliminated symbol). In some embodiments such a process of identifying the player selectable element to be eliminated may be performed upon bonus round being triggered while in other embodiments this step may be performed upon the eliminator symbol being collected by the player. For example, in embodiments in which the plurality of player selectable elements comprising a bonus round are pre-determined, identifying the player selectable element to be eliminated may be performed dynamically in the background as a player wins eliminator symbols during the primary game even if the bonus round has not yet been triggered. It should be noted that, in accordance with at least some embodiments, reference to a player "collecting" or "winning" an eliminator symbol refers to an eliminator symbol being output as part of an outcome of a game event in the primary game or otherwise comprising a result of the primary game.

In some embodiments, player selectable elements of a bonus round may each be associated with a respective value, whether a monetary value (e.g., of a number of credits or a value of currency to be awarded upon selection of the associated player selectable element) or a non-monetary value (e.g., a binary non-monetary value such as "0" for a player selectable element which does not contribute to a prize being won by a player if it is selected and a "1" for a player selectable element which does contribute to a prize being won by a player if it is selected). In one non-limiting example, in a DEAL OR NO DEAL™ themed game, the eliminator symbols obtained in a primary game could function to remove lower value suitcases from a grid or other representation of a plurality of available suitcases, such that the player would have not only fewer suitcases to reveal or open once the player enters the bonus round, but the suitcases or choices left as available for selection during the bonus round would be the higher valued ones.

In some embodiments, identifying or determining which player selectable elements to remove or render unavailable may comprise removing or rendering unavailable for selection the player selectable element(s) having the lowest value(s) of the values still remaining available for selection at the time of the identifying. In other embodiments (e.g., particularly embodiments in which player selectable elements may not be differentiated by value or be associated with the same or similar values), player selectable elements for removal or unavailability may be identified or determined on a random or semi-random basis (e.g., random but weighted towards low value player selectable elements being removed).

In accordance with one illustrative and non-limiting embodiment, during play of a primary game and prior to entering a bonus round, a player may obtain eliminator symbols for a bonus round the appearance of which functions to remove "incorrect" choices from one or more categories of choices (i.e., choices which are not part of the winning combination of choices associated with the prize). Thus, returning to the non-limiting and illustrative CLUE™ themed example, during play of a primary game a player may win eliminator symbols (e.g., labeled as "Clues") which function to eliminate suspects, weapons and/or rooms from a list of choices in each respective category, such that once the player enters the bonus round the player is more likely to guess the correct combination of suspect, weapon and room because the player will have fewer choices to consider in each category within the predetermined or maximum number of selections or time provided. In other words, for each "Clue" eliminator symbol collected by the player during the bonus round, a bonus round symbol is eliminated from a list of choices output to the player once the player enters the bonus round (e.g., one of a suspect, room or weapon is eliminated for each Clue symbol collected).

In some embodiments, different types of eliminator symbols may be won or collected by a player during play of a primary game. Each different type of eliminator symbol may correspond to a different function or effect. For example, a first type of eliminator symbol may function to eliminate a player selectable element of a bonus round having a first characteristic (e.g., one of the "who did it" selections in a CLUE™-themed game) while a second type of eliminator symbol may function to eliminate a player selectable element of the bonus round having a second characteristic (e.g., one of the "which weapon" selections in a CLUE™-themed game).

Certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

Although several embodiments, examples and illustrations are disclosed below, it will be understood by those of ordinary skill in the art that the invention described herein extends beyond the specifically disclosed embodiments, examples and illustrations and includes other uses of the invention and obvious modifications and equivalents thereof. Embodiments of the invention(s) are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention(s). In addition, embodiments of the invention(s) can comprise several novel features and it is possible that no single feature is solely responsible for its desirable attributes or is essential to practicing the invention(s) herein described.

Throughout the description that follows and unless otherwise specified, the following terms may include and/or encompass the example meanings provided in this section. These terms and illustrative example meanings are provided to clarify the language selected to describe embodiments both in the specification and in the appended claims, and accordingly, are not intended to be limiting. Other terms are defined throughout the present description.

A "game", as the term is used herein unless specified otherwise, may comprise any game (e.g., wagering or non-wagering, electronically playable over a network) playable by one or more players in accordance with specified rules. A game may be playable on a personal computer online in web browsers, on a game console and/or on a mobile device such as a smart-phone or tablet computer. A game may also be playable on a dedicated gaming device (e.g., a slot machine in a brick-and-mortar casino). "Gaming" thus refers to play of a game.

A "casual game", as the term is used herein unless specified otherwise, may comprise a game with simple rules with little or no time commitment on the time of a player to play. A casual game may feature, for example, very simple game play such as a puzzle or Scrabble™ game, may allow for short bursts of play (e.g., during work breaks), an ability to quickly reach a final stage and/or continuous play without a need to save the game.

A "social network game", as used herein unless specified otherwise, refers to a type of online game that is played through a social network, and in some embodiments may feature multiplayer and asynchronous game play mechanics. A "social network" may refer to an online service, online community, platform, or site that focuses on facilitating the building of social networks or social relations among people. A social network service may, for example, consist of a representation of each user (often a profile), his/her social links, and a variety of additional services. A social network may be web-based and provide means for users to interact over the Internet, such as e-mail and instant messaging. A social network game may in some embodiments be implemented as a browser game, but can also be implemented on other platforms such as mobile devices.

A "wagering game", as the term is used herein, may comprise a game on which a player can risk a wager or other consideration, such as, but not limited to: slot games, poker games, blackjack, baccarat, craps, roulette, lottery, bingo, keno, casino war, etc. A wager may comprise a monetary wager in the form of an amount of currency or any other tangible or intangible article having some value which may be risked on an outcome of a wagering game. "Gambling" or "wagering" refers to play of a wagering game.

The term "game provider", as used herein unless specified otherwise, refers to an entity or system of components which provides, or facilitates the provision of, games for play and/or facilitates play of such game by use of a network such as the Internet or a proprietary or closed networks (e.g., an intranet or wide area network). For example, a game provider may operate a website which provides games in a digital format over the Internet. In some embodiments in which a game comprising a wagering game is provided, a game provider may operate or facilitate a gambling website over which wagers are accepted and results of wagering games are provided.

The terms "information" and "data", as used herein unless specified otherwise, may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard as defined by "Internet Protocol Version 6 (IPv6) Specification" RFC 1883, published by the Internet Engineering Task Force (IETF), Network Working Group, S. Deering et al. (December 1995). Information may, according to some embodiments, be compressed, encoded, encrypted, and/or otherwise packaged or manipulated in accordance with any method that is or becomes known or practicable.

The term "indication", as used herein unless specified otherwise, may refer to any indicia and/or other information indicative of or associated with a subject, item, entity, and/or other object and/or idea. As used herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

The term "network component," as used herein unless specified otherwise, may refer to a user or network device, or a component, piece, portion, or combination of user or network devices. Examples of network components may include a Static Random Access Memory (SRAM) device or module, a network processor, and a network communication path, connection, port, or cable.

In addition, some embodiments are associated with a "network" or a "communication network". As used herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration of type that is or becomes known. Communication networks may include, for example, one or more networks configured to operate in accordance with the Fast Ethernet LAN transmission standard 802.3-2002® published by the Institute of Electrical and Electronics Engineers (IEEE). In some embodiments, a network may include one or more wired and/or wireless networks operated in accordance with any communication standard or protocol that is or becomes known or practicable.

The term "player," as used herein unless specified otherwise, may refer to any type, quantity, and or manner of entity associated with the play of a game. In some embodiments, a player may comprise an entity (i) conducting play of an online game, (ii) that desires to play a game (e.g., an entity registered and/or scheduled to play and/or an entity having expressed interest in the play of the game—e.g., a spectator) and/or may (iii) that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game).

Some embodiments described herein are associated with a "player device" or a "network device". As used herein, a "player device" is a subset of a "network device". The "network device", for example, may generally refer to any device that can communicate via a network, while the "player device" may comprise a network device that is owned and/or operated by or otherwise associated with a player. Examples of player and/or network devices may include, but are not limited to: a Personal Computer (PC), a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components.

A "session" comprises a period of time spanning a plurality of event instances, game instances, spins or turns of a game, the session having a defined start and defined end. An "event instance", "game instance", "session" or "turn" is triggered upon an initiation of, or request for, at least one result of the game by a player, such as an actuation of a "start" or "spin" mechanism, which initiation causes an outcome to be determined or generated (e.g., a random number generator is contacted or communicated with to identify, generate or determine a random number to be used to determine a result for the event instance). An event instance or turn may comprise an event instance or turn of a primary game or an event instance or turn of a bonus round, mode or feature of the game. Accordingly, a session may refer to a session of a primary game or a session of a bonus round, mode or feature of the game, depending on the context.

An "outcome" should be differentiated from a "result" in the present description in that an "outcome" is a representation of a "result", typically comprising one or more game elements or game symbols. For example, in a "fruit themed" game, a winning outcome (i.e., an outcome corresponding to some kind of award, prize or payout) may comprise a combination of three "cherry" symbols. The "result" of this outcome may be a payout of X credits awarded to the player associated with the game. In another example, in a game in which a character moves along a game interface from a starting position to a finish position, an "outcome" of the game may comprise a symbol representing one or more movements along the interface and the "result" corresponding to this outcome may be the particular number and direction of the character's movement (e.g., three spaces backwards such that the character ends up further away from the finish line). In a session embodiment, a session result may comprise a binary result (e.g., a player or game character wins or loses the session) and/or the particular award (or magnitude of award) won or earned by the player based on the session (e.g., the number of credits awarded to the player). It should be noted that the embodiments described herein encompass prizes which may comprise awards, payouts, discounts, eligibility, advancement in a game or other benefits (whether monetary or non-monetary, tangible or intangible) to a player and that any reference to a "prize", "award" or "payout" may refer to any or all of the foregoing, unless the context explicitly indicates otherwise.

A "bonus round", "bonus mode" or "bonus feature" of a game, as the terms are used interchangeably herein unless indicated otherwise, may refer to a secondary phase of a game, entry into which is triggered via one or more events which may occur in a base or primary phase of the game (the base or primary phase of the game is also referred to as the primary game herein). Typically, a player may be able to qualify to play a bonus round based on one or more outcomes in a primary game. A bonus round may be played in accordance with a set of rules that is different from those of a primary game, and may be accompanied by displays, colors, sounds, animated sequences, game play and/or prizes that are not part of the primary game. In one embodiment, a primary or base game application or program may include programming or instructions which will automatically begin a bonus round after the player has achieved a triggering event or qualifying condition in the primary game.

"Virtual currency" as the term is used herein unless indicated otherwise, refers to an in-game currency that may be used as part of a game or one or more games provided by a game provider as (i) currency for making wagers, and/or (ii) to purchase or access various in-game items, features or powers. References to an "award", "prize" and/or "payout" herein are intended to encompass such in the form of virtual currency, credits, real currency or any other form of value, tangible or intangible.

A "credit balance", as the term is used herein unless indicated otherwise, refers to (i) a balance of currency, whether virtual currency or real currency, usable for making wagers or purchases in the game (or relevant to the game), and/or (ii) another tracking mechanism for tracking a player's success or advancement in a game by deducting therefrom points or value for unsuccessful attempts at advancement and adding thereto points or value for successful attempts at advancement. A credit balance may be increased or replenished with funds external to the game. For example, a player may transfer funds to the credit balance from a financial account or a gaming establishment may add funds to the credit balance due to a promotion, award or gift to the player.

DESCRIPTION OF FIGURES

Example Systems

Referring now to the figures, FIG. 1 depicts a block diagram of an example system 100 according to some embodiments. The system 100 may comprise a plurality of player devices 102*a*-102*n* in communication with a game server 110 via a network 104. For purposes of brevity, any or all of the player devices 102*a*-102*n* will be referred to as a player device 102 herein, even though the plurality of player devices 102*a*-102*n* may include different types of player devices (as described below). The game server 110 may also be operable to communicate with or access a database 140 (which may comprise one or more databases and/or tables and which may comprise a storage device distinct from (or be a component of) the game server 110). It should be noted that in some embodiments database 140 may be stored on a game server 110 while in other embodiments database 140 may be stored on another computing device with which game server 110 is operable to communicate in order to at least access the data in database 140 (e.g., another server device remote from game server 140, operable to determine outcomes for an event instance of a game). In some embodiments a processor (e.g., one or more microprocessors, one or more microcontrollers, one or more digital signal processors) of a player device 102 and/or game server 110 may receive instructions (e.g., from a memory or like device), and execute those instructions, thereby performing one or more processes defined by those instructions. Instructions may be embodied in, e.g., one or more computer programs and/or one or more scripts.

In some embodiments a game server 110 and/or one or more of the player devices 102 stores and/or has access to data useful for facilitating play of a game. For example, game server 110 and/or a player device 102 may store (i) one or more probability databases for determining one or more outcome(s) for an event instance, spin or turn of a game, (ii) a current state or status of a game or game session (e.g., a number of eliminator symbols collected during play of the primary game), (iii) one or more user interfaces for use in a game, (iv) one or more game themes for a game and/or (v) profiles or other personal information associated with a player of a game. It should be noted that in some embodiments such data may be stored on the game server 110 and information based on such data may be output to a player device 102 during play of a game while in other embodiments a game program may be downloaded to a local memory of a player device 102 and thus such data may be stored on a player device 102 (e.g., in encrypted or other secure or tamper-resistant form).

A game server 110 may comprise a computing device for facilitating play of a game (e.g., by receiving an input from a player, determining an outcome for a game, causing an outcome of a game to be displayed on a player device, adjusting a number of collected eliminator symbols, facilitating a wager and/or facilitating a provision of a payout for a game). For example, the game server 110 may comprise a server computer operated by a game provider or another entity (e.g., a social network website not primarily directed at providing games). In some embodiments, the game server may determine an outcome for spin of a game by requesting and receiving such an outcome from another remote server operable to provide such outcomes. In some embodiments, the game server 110 may further be operable to facilitate a game program for a game (e.g., a wagering game). In accordance with some embodiments, in addition to administering or facilitating play of a game, a game server 110 may comprise one or more computing devices responsible for handling online processes such as, but not limited to: serving a website comprising one or more games to a player device and/or processing transactions (e.g., wagers, deposits into financial accounts, managing accounts, controlling games, etc). In some embodiments, game server 110 may comprise two or more server computers operated by the same entity (e.g., one server being primarily for storing states of games in progress and another server being primarily for storing mechanisms for determining outcomes of games, such as a random number generator). Examples of processes that may be performed by the game server 110 (directly or indirectly) may include, but are not limited to: (i) determining an outcome of a primary game, including determining a number (which may be zero) of eliminator symbols to be earned (e.g., in the case of a non-wagering or social game) or won (e.g., in the case of a wagering game) by the player as a result of the outcome; (ii) determining whether the outcome causes a bonus round to be initiated; (iii) determining a plurality of player selectable elements to populate a bonus round interface with, which may include (a) determining a value and/or placement for each respective player selectable element and/or (b) the correct or winning player selectable element (or set of player selectable elements) for winning a prize in the bonus round; (iv) determining whether to eliminate any player selectable elements from the bonus round based on eliminator symbols earned or won by the player in the primary game; (v) receiving a player input, such as an indication of which player selectable element(s) the player selected during the bonus round; (vi) transmitting an indication of outcomes to a player device; (vii) authorizing a game program to be downloaded to a player device; and/or (viii) determining a result of a bonus round based on player selections of player selectable elements comprising the bonus round.

Turning now to a description of a player device 102, in accordance with some embodiments a player device 102 may comprise a computing device that is operable to execute or facilitate the execution of a game program and used or useful by an online player for accessing an online casino or other electronic (e.g., online) game provider. For example, a player device 102 may comprise a desktop computer, computer workstation, laptop, mobile device, tablet computer, Personal Digital Assistant (PDA) devices, cellular or other wireless telephones (e.g., the Apple™ iPhone™), video game consoles (e.g., Microsoft™ Xbox 360™, Sony™ Plasystation™, and/or Nintendo™ Wii™), and/or handheld or portable video game devices (e.g., Nintendo™ Game Boy™ or Nintendo™ DS™). A player device 102 may comprise and/or interface with various components such as input and output devices (each of which is described in detail elsewhere herein) and, in some embodiments, game server 110. A player device 102 may be a dedicated gaming device (e.g., a slot machine) or a non-dedicated gaming device (e.g., an iPad™). It should be noted that a game server 110 may be in communication with a variety of different types of player devices 102.

A player device 102 may be used to play a wagering or non-wagering game (e.g., a social or casual game) over a network and output information relating to the game to players participating in the game (e.g., outcomes for an event instance of the game, qualifying for a bonus round of the game, credit balance of credits available for play of the game, a session result for a session of the game, etc.). Any and all information relevant to any of the aforementioned functions may be stored locally on one or more of the player devices 102 and/or may be accessed using one or more of the player devices 102 (in one embodiments such information being stored on, or provided via, the game server 110). In another embodiment, a player device 102 may store some or all of the program instructions for determining, for example, (i) that an event instance (e.g., a new spin or other request for a new outcome) has been triggered or initiated (and, in some embodiments, communicating such a trigger or initiation to game server 110), (ii) a first outcome for a first aspect of the game (e.g., an outcome of the primary game, which may include determining whether the outcome is to include any eliminator symbols and, in some embodiments, the value and/or other characteristic of any eliminator symbols to be included); (iii) determining a second outcome for a second aspect of the game (e.g., a plurality of player selectable elements for the bonus round which may be triggered during the primary game); (iv) a result of a spin of the primary game, and/or (iv) a result of a bonus round. In some embodiments, the game server 110 may be operable to authorize the one or more player devices 102 to access such information and/or program instructions remotely via the network 104 and/or download from the game server 110 (e.g., directly or via an intermediary server such as a web server) some or all of the program code for executing one or more of the various functions described in this disclosure. In other embodiments, outcome and result determinations may be carried out by the game server 110 (or another server with which the game server 110 communicates) and the player devices 102 may be terminals for displaying to an associated player such outcomes and results and other graphics and data related to a game.

It should be noted that the one or more player devices 102 may each be located at the same location as at least one other player device 102 (e.g., such as in a casino or internet café) or remote from all other player devices 102. Similarly, any given player device may be located at the same location as the game server 110 or may be remote from the game server 110.

It should further be noted that while the game server 110 may be useful or used by any of the player devices 102 to perform certain functions described herein, the game server 110 need not control any of the player devices 102. For example, in one embodiment the game server 110 may comprise a server hosting a website of an online casino accessed by one or more of the player devices 102. In accordance with some embodiments, a player device 102 may optionally communicates with game server 110 such that each player device 102 operates as a "thin client" having relatively less functionality, a "thick client" having relatively more functionality or with any range of functionality therebetween (e.g., an "intermediate client").

In one embodiment, a game server 110 may not be necessary or desirable. For example, some embodiments described in this disclosure may be practiced on one or more player devices 102 without a central authority. In such an embodiment, any functions described herein as performed by a game server 110 and/or data described as stored on a game server 110 may instead be performed by or stored on one or more player devices 102. Additional ways of distributing information and program instructions among one or more player devices 102, a game server 110 and/or another server device will be readily understood by one skilled in the art upon contemplation of the present disclosure.

Figure 2:
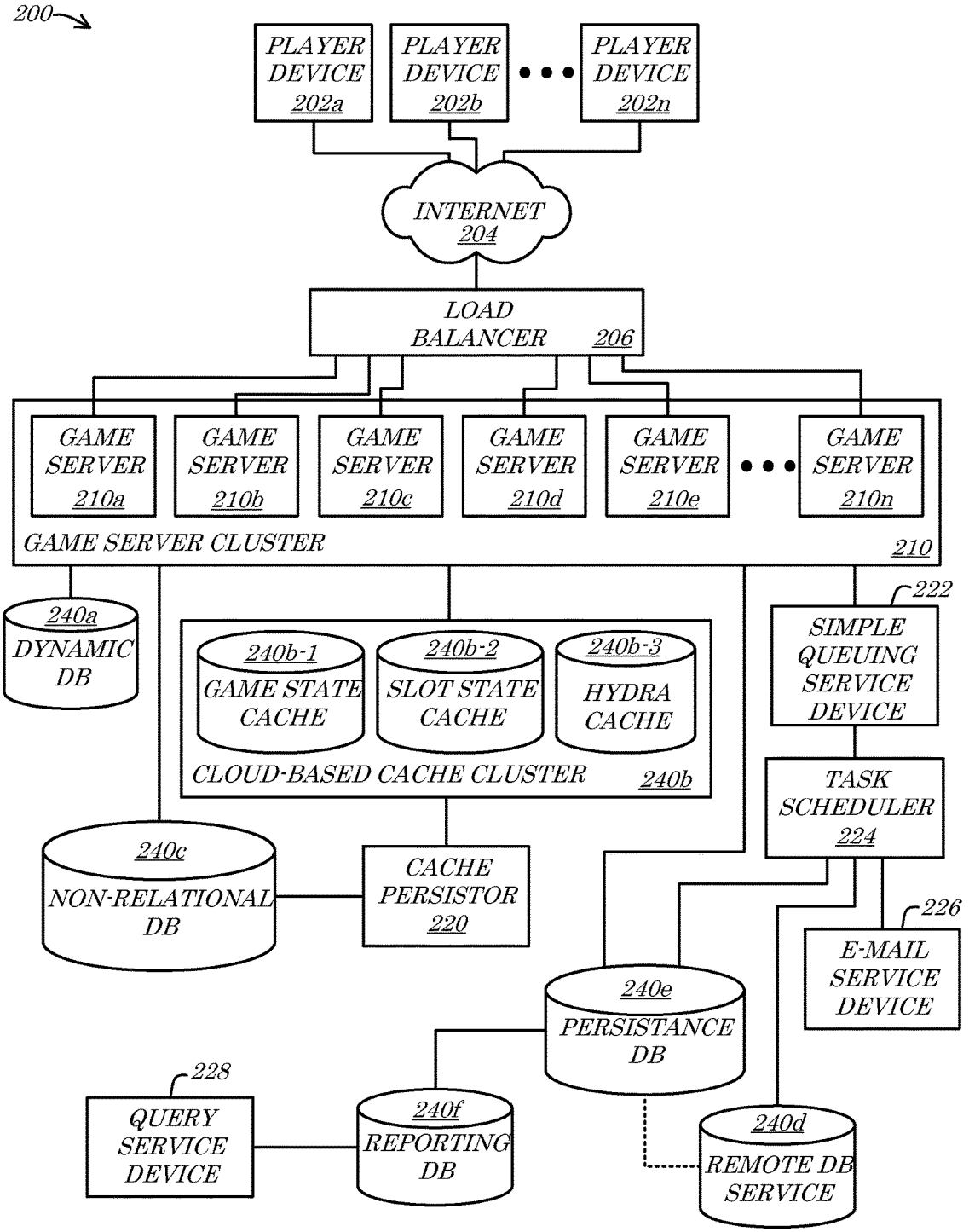
FIG. 2 is a schematic diagram of an embodiment of a social gaming platform in accordance with one or more embodiments described herein.

FIG. 2 a block diagram of an example system 200, which is consistent with some embodiments. In accordance with some embodiments, the system 200 may comprise a plurality of player devices 202*a-n*, the Internet 204, a load balancer 206, and/or a game server cluster 210. The game server cluster 210 may, in some embodiments, comprise a plurality of game servers 210*a-n*. In some embodiments, the system 200 may comprise a cache persistor 220, a Simple Queuing Service (SQS) device 222, a task scheduler 224, an e-mail service device 226, and/or a query service device 228. As depicted in FIG. 2, any or all of the various components 202*a-n*, 204, 206, 210*a-n*, 220, 222, 224, 226, 228 may be in communication with and/or coupled to one or more databases 240*a-f*. The system 200 may comprise, for example, a dynamic DataBase (DB) 240*a*, a cloud-based cache cluster 240*b* (e.g., comprising a game state cache 240*b*-1, a slot state cache 240*b*-2, and/or a "hydra" cache 240*b*-3), a non-relational DB 240*c*, a remote DB service 240*d*, a persistence DB 240*e*, and/or a reporting DB 240*f*.

According to some embodiments, any or all of the components 202*a-n*, 204, 206, 210*a-n*, 220, 222, 224, 226, 228, 240*a-f* of the system 200 may be similar in configuration and/or functionality to any similarly named and/or numbered components described herein. Fewer or more components 202*a-n*, 204, 206, 210*a-n*, 220, 222, 224, 226, 228, 240*a-f* (and/or portions thereof) and/or various configurations of the components 202*a-n*, 204, 206, 210*a-n*, 220, 222, 224, 226, 228, 240*a-f* may be included in the system 200 without deviating from the scope of embodiments described herein. While multiple instances of some components 202*a-n*, 210*a-n*, 240*a-f* are depicted and while single instances of other components 204, 206, 220, 222, 224, 226, 228 are depicted, for example, any component 202*a-n*, 204, 206, 210*a-n*, 220, 222, 224, 226, 228, 240*a-f* depicted in the system 200 may comprise a single device, a combination of devices and/or components 202*a-n*, 204, 206, 210*a-n*, 220, 222, 224, 226, 228, 240*a-f*, and/or a plurality of devices, as is or becomes desirable and/or practicable. Similarly, in some embodiments, one or more of the various components 202*a-n*, 204, 206, 210*a-n*, 220, 222, 224, 226, 228, 240*a-f* may not be needed and/or desired in the system 200.

According to some embodiments, the player device 202*a-n* may be utilized to access (e.g., via the Internet 204 and/or one or more other networks not explicitly shown) content provided by the game server cluster 210. The game server cluster 210 may, for example, provide, manage, host, and/or conduct various online and/or otherwise electronic games such as online bingo, slots, poker, and/or other games of chance, skill, and/or combinations thereof. In some embodiments, the various game servers 210*a-n* (virtual and/or physical) of the game server cluster 210 may be configured to provide, manage, host, and/or conduct individual instances of available game types. A first game server 210*a*, for example, may host a first particular instance of an online game consistent with embodiments described herein (or tournament), a second game server 210*c* may host a second particular instance of an online game consistent with embodiments described herein (or tournament), a third game server 210*c* may facilitate an online poker tournament, and/or a fourth game server 210*d* may provide an online slots game.

In some embodiments, the player devices 202*a-n* may comprise various components (hardware, firmware, and/or software; not explicitly shown) that facilitate game play and/or interaction with the game server cluster 210. The player device 202*a-n* may, for example, comprise a gaming client such as a software application programmed in Adobe® Flash® and/or HTML 5 that is configured to send requests to, and receive responses from, one or more of the game servers 210*a-n* of the game server cluster 210. In some embodiments, such an application operating on and/or via the player devices 202*a-n* may be configured in Model-View-Controller (MVC) architecture with a communication manager layer responsible for managing the requests to/responses from the game server cluster 210. In some embodiments, one or more of the game servers 210*a-n* may also or alternatively be configured in a MVC architecture with a communication manager and/or communications management layer. In some embodiments, communications between the player devices 202*a-n* and the game server cluster 210 may be conducted in accordance with the HyperText Transfer Protocol (HTTP) version 1.1 (HTTP/1.1) as published by the Internet Engineering Taskforce (IET) and the World Wide Web Consortium (W3C) in RFC 2616 (June 1999).

According to some embodiments, communications between the player devices 202*a-n* and the game server cluster 210 may be managed and/or facilitated by the load balancer 206. The load balancer 206 may, for example, route communications from player devices 202*a-n* to one or more of the specific game servers 210*a-n* depending upon various attributes and/or variables such as bandwidth availability (e.g., traffic management/volumetric load balancing), server load (e.g., processing load balancing), server functionality (e.g., contextual awareness/availability), and/or player-server history (e.g., session awareness/stickiness). In some embodiments, the load balancer 206 may comprise one or more devices and/or services provided by a third-party (not shown). The load balancer 206 may, for example, comprise an Elastic Load Balancer (ELB) service provided by Amazon® Web Services, LLC of Seattle, Wash. According to some embodiments, such as in the case that the load balancer 206 comprises the ELB or a similar service, the load balancer 206 may manage, set, determine, define, and/or otherwise influence the number of game servers 210*a-n* within the game server cluster 210. In the case that traffic and/or requests from the player devices 202*a-n* only require the first and second game servers 210*a-b*, for example, all other game servers 210*c-n* may be taken off-line, may not be initiated and/or called, and/or may otherwise not be required and/or utilized in the system 200. As demand increases (and/or if performance, security, and/or other issues cause one or more of the first and second game servers 210*a-b* to experience detrimental issues), the load balancer 206 may call and/or bring online one or more of the other game servers 210*c-n* depicted in FIG. 2. In the case that each game server 210*a-n* comprises an instance of an Amazon® Elastic Compute Cloud (EC2) service, the load balancer 206 may add or remove instances as is or becomes practicable and/or desirable.

In some embodiments, the load balancer 206 and/or the Internet 204 may comprise one or more proxy servers and/or devices (not shown in FIG. 2) via which communications between the player devices 202*a-n* and the game server cluster 210 are conducted and/or routed. Such proxy servers and/or devices may comprise one or more regional game hosting centers, for example, which may be geographically dispersed and addressable by player devices 202*a-n* in a given geographic proximity. In some embodiments, the proxy servers and/or devices may be located in one or more geographic areas and/or jurisdictions while the game server cluster 210 (and/or certain game servers 210*a-n* and/or groups of game servers 210*a-n* thereof) is located in a separate and/or remote geographic area and/or jurisdiction.

According to some embodiments, for some game types the game server cluster 210 may provide game outcomes to a controller device (not separately shown in FIG. 2) that times the release of game outcome information to the player devices 202*a-n* such as by utilizing a broadcaster device (also not separately shown in FIG. 2) that transmits the time-released game outcomes to the player devices 202*a-n* (e.g., in accordance with the Transmission Control Protocol (TCP) and Internet Protocol (IP) suite of communications protocols (TCP/IP), version 4, as defined by "Transmission Control Protocol" RFC 793 and/or "Internet Protocol" RFC 791, Defense Advance Research Projects Agency (DARPA), published by the Information Sciences Institute, University of Southern California, J. Postel, ed. (September 1981)).

In some embodiments, the game server cluster 210 (and/or one or more of the game servers 210*a-n* thereof) may be in communication with the dynamic DB 240*a*. According to some embodiments, the dynamic DB 240*a* may comprise a dynamically-scalable database service such as the DyanmoDB™ service provided by Amazon® Web Services, LLC. The dynamic DB 240*a* may, for example, store information specific to one or more certain game types (e.g., a reeled slots themed game) provided by the game server cluster 210 such as to allow, permit, and/or facilitate reporting and/or analysis of such information.

According to some embodiments, the game server cluster 210 (and/or one or more of the game servers 210*a-n* thereof) may be in communication with the cloud-based cache cluster 240*b*. Game state information from the game server cluster 210 may be stored in the game state cache 240*b*-1, for example, slot state (e.g., slot-game specific state) data may be stored in the slot state cache 240*b*-2, and/or other game and/or player information (e.g., progressive data, player rankings, audit data) may be stored in the hydra cache 240*b*-3. In some embodiments, the cache persistor 220 may move and/or copy data stored in the cloud-based cache cluster 240*b* to the non-relational DB 240*c*. The non-relational DB 240*c* may, for example, comprise a SimpleDB™ service provided by Amazon® Wed Services, LLC. According to some embodiments, the game server cluster 210 may generally access the cloud-based cache cluster 240*b* as-needed to store and/or retrieve game-related information. The data stored in the cloud-based cache cluster 240*b* may generally comprise a subset of the newest or freshest data, while the cache persistor 220 may archive and/or store or move such data to the non-relational DB 240*c* as it ages and/or becomes less relevant (e.g., once a player logs-off, once a game session and/or tournament ends). The game server cluster 210 may, in accordance with some embodiments, have access to the non-relational DB 240*c* as-needed and/or desired. The game servers 210*a-n* may, for example, be initialized with data from the non-relational DB 240*c* and/or may store and/or retrieve low frequency and/or low priority data via the non-relational DB 240*c*.

In some embodiments, the SQS device 222 may queue and/or otherwise manage requests, messages, events, and/or other tasks or calls to and/or from the server cluster 210. The SQS device 222 may, for example, prioritize and/or route requests between the game server cluster 210 and the task scheduler 224. In some embodiments, the SQS device 222 may provide mini-game and/or tournament information to the server cluster 210. According to some embodiments, the task scheduler 224 may initiate communications with the SQS device 222, the e-mail service provider 226 (e.g., providing e-mail lists), the remote DB service 240*d* (e.g., providing inserts and/or updates), and/or the persistence DB 240*e* (e.g., providing and/or updating game, player, and/or other reporting data), e.g., in accordance with one or more schedules.

According to some embodiments, the persistence DB 240*e* may comprise a data store of live environment game and/or player data. The game server cluster 210 and/or the task scheduler 224 or SQS device 222 may, for example, store game and/or player data to the persistence DB 240*e* and/or may pull and/or retrieve data from the persistence DB 240*e*, as-needed and/or desired. The server cluster 210 may, according to some embodiments, provide and/or retrieve spin and/or other game event info and/or configuration information via the persistence DB 240*e*.

In some embodiments, the reporting DB 240*f* may be created and/or populated based on the persistence DB 240*e*. On a scheduled and/or other basis, for example, a data transformation and/or mapping program may be utilized to pull data from the live environment (e.g., the persistence DB 240*e*) into the reporting DB 240*f*. The query service 228 may then be utilized, for example, to query the reporting DB 240*f*, without taxing the live environment and/or production system directly accessible by the game server cluster 210.

Figure 3:
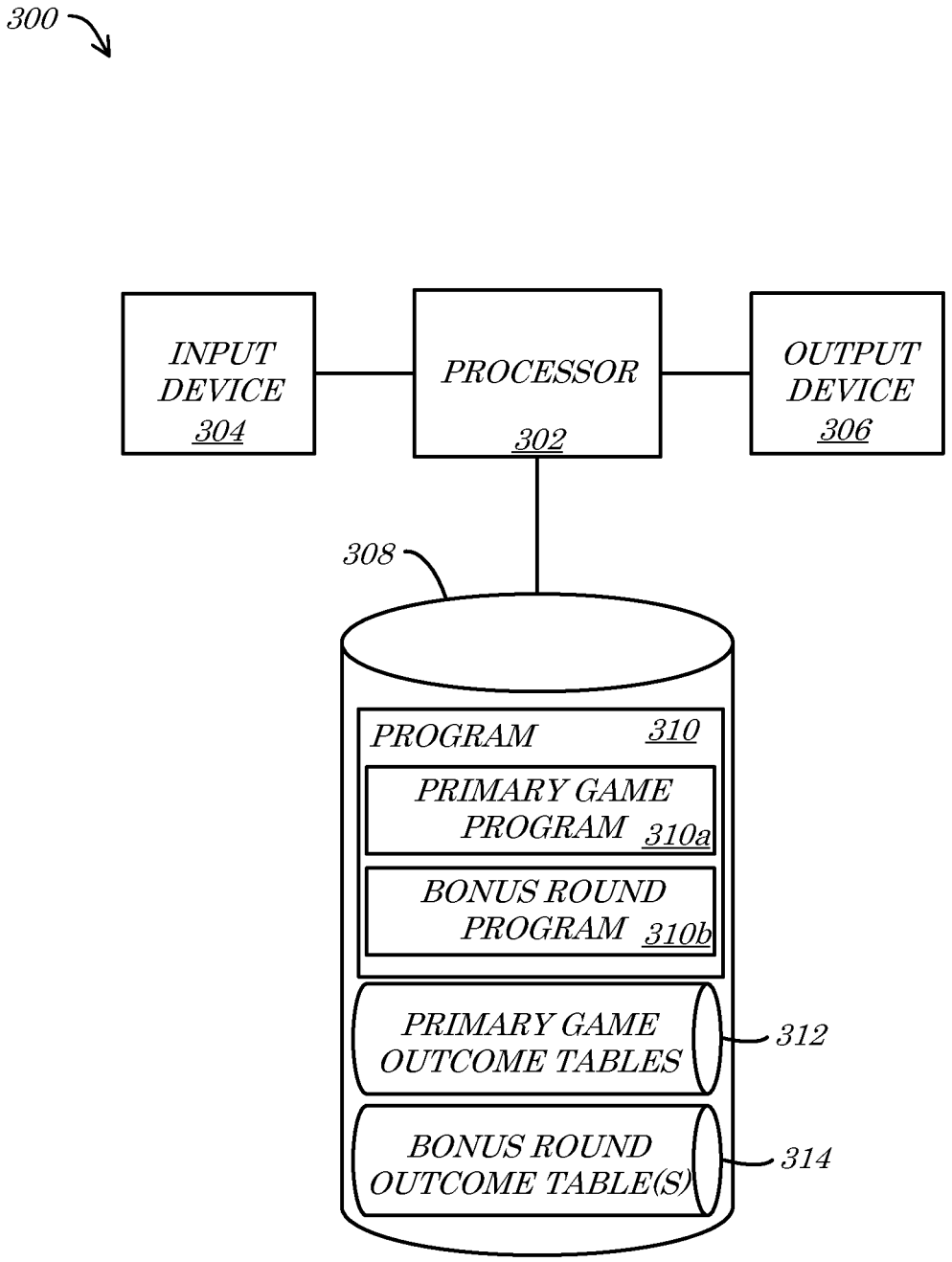
FIG. 3 is a block diagram of an embodiment of a computing device useful in a system according to one or more embodiments described herein.

FIG. 3 is a block diagram of an apparatus 300 according to some embodiments. In some embodiments, the apparatus 300 may be similar in configuration and/or functionality to any of the player devices 102, the game server 110 and/or another server device operable to facilitate the embodiments described herein. The apparatus 300 may, for example, execute, process, facilitate, and/or otherwise be associated with any of the processes 700 and/or 800 described herein in conjunction with FIG. 7 and FIG. 8, respectively.

In some embodiments, the apparatus 300 may comprise a processor 302, an input device 304, an output device 306 and/or a memory device 308. Fewer or more components and/or various configurations of the components 302, 304, 306 and/or 308 may be included in the apparatus 300 without deviating from the scope of embodiments described herein.

According to some embodiments, the processor 302 may be or include any type, quantity, and/or configuration of processor that is or becomes known. The processor 302 may comprise, for example, an Intel® IXP 2800 network processor or an Intel® XEON™ Processor coupled with an Intel® E7501 chipset. In some embodiments, the processor 302 may comprise multiple inter-connected processors, microprocessors, and/or micro-engines. According to some embodiments, the processor 302 (and/or the apparatus 300 and/or other components thereof) may be supplied power via a power supply (not shown) such as a battery, an Alternating Current (AC) source, a Direct Current (DC) source, an AC/DC adapter, solar cells, and/or an inertial generator. In the case that the apparatus 302 comprises a server such as a blade server, necessary power may be supplied via a standard AC outlet, power strip, surge protector, and/or Uninterruptible Power Supply (UPS) device.

In some embodiments, the input device 304 and/or the output device 306 are communicatively coupled to the processor 302 (e.g., via wired and/or wireless connections and/or pathways) and they may generally comprise any types or configurations of input and output components and/or devices that are or become known, respectively.

The input device 304 may comprise, for example, a keyboard that allows an operator of the apparatus 300 to interface with the apparatus 200 (e.g., by a player, an employee or other worker affiliated with either an online casino or other entity operating a system which provides games to players). In some embodiments, the input device 304 may comprise a mechanism configured to indicate to a remote server device an initiation or triggering of an event instance (e.g., that a player has actuated a "reel spin" mechanism and thus initiated a new spin of a reels-based game), such information being provided to the apparatus 300 and/or the processor 302. In such embodiments, the input device may comprise a key on a keyboard of the apparatus 300. Other examples of input devices include, but are not limited to: a game controller and/or gamepad, a bar-code scanner, a magnetic stripe reader, a pointing device (e.g., a computer mouse, touchpad, and/or trackball), a point-of-sale terminal keypad, a touch-screen, a microphone, an infrared sensor, a sonic ranger, a computer port, a video camera, a motion detector, a digital camera, a network card, a Universal Serial Bus (USB) port, a GPS receiver, a Radio Frequency Identification (RFID) receiver, a RF receiver, a thermometer, a pressure sensor, and a weight scale or mass balance.

The output device 306 may, according to some embodiments, comprise a display screen and/or other practicable output component and/or device that is operable to output information. The output device 306 may, for example, comprise a display screen via which are output outcomes, instructions, guidance, questions or information to a player of a game. For example, the output device may output a game interface for a bonus round which comprises a plurality of player selectable elements, such as the bonus round symbols populated into respective ones of a plurality of symbol positions comprising the game interface, an indication that a bonus round symbol has been eliminated as a result of an eliminator symbol won during the primary game and/or any payouts or other awards won or earned by a player as a result of an outcome of the game (primary or bonus round). Some additional examples of output devices that may be useful in some embodiments include a Cathode Ray Tube (CRT) monitor, a Liquid Crystal Display (LCD) screen, a Light Emitting Diode (LED) screen, a printer, an audio speaker, an Infra-red Radiation (IR) transmitter, an RF transmitter, and/or a data port. According to some embodiments, the input device 304 and/or the output device 306 may comprise and/or be embodied in a single device such as a touch-screen display or screen.

In some embodiments, the apparatus 300 may comprise any type or configuration of communication device (not shown) that is or becomes known or practicable. For example, the apparatus 300 may include a communication device such as a NIC, a telephonic device, a cellular network device, a router, a hub, a modem, and/or a communications port or cable. In some embodiments, the communication device may be coupled to provide data to a telecommunications device. The communication device may, for example, comprise a cellular telephone network transmission device that sends signals (e.g., an initiation of an event instance) to a server (e.g., game server 110) in communication with a plurality of player devices 102. According to some embodiments, the communication device may also or alternatively be coupled to the processor 302. In some embodiments, the communication device may comprise an IR, RF, Bluetooth™, and/or Wi-Fi® network device coupled to facilitate communications between the processor 202 and another device.

The memory device 308 may comprise any appropriate information storage device that is or becomes known or available, including, but not limited to, units and/or combinations of magnetic storage devices (e.g., a hard disk drive), optical storage devices, and/or semiconductor memory devices such as Random Access Memory (RAM) devices, Read Only Memory (ROM) devices, Single Data Rate Random Access Memory (SDR-RAM), Double Data Rate Random Access Memory (DDR-RAM), and/or Programmable Read Only Memory (PROM).

The memory device 308 may, according to some embodiments, store a program 310 for facilitating one or more of the embodiments described herein, which program may include a primary game program 310*a* for facilitating a primary aspect of a game (in some embodiments the program 310 may further include a bonus round program for facilitating a bonus round of the game, not shown). In some embodiments, the primary game program 310*a* and/or the bonus round program 310*b* (not shown) may be utilized by the processor 302 to provide output information via the output device 306.

The primary game program 310*a* may, for example, provide instructions for determining at least one of: (i) an outcome for the primary game responsive to a wager or other input from a player which initiates an event instance of the game (e.g., by requesting a random number from another server or device), (ii) which symbol positions (e.g., reel positions) should be populated with which symbols (e.g., determining whether any eliminator symbols should be included in an outcome of an event instance of the game and, in some embodiments, which symbol positions the eliminator symbols should be populated); (iii) whether (and if so by how much) to increase a number of collected eliminator symbols as a result of the event instance; (iv) increasing the credit balance of the player based on any payouts won as a result of the outcome; and (v) whether a bonus round has been triggered as a result of the game instance. In one embodiment, the primary game program 310 may include an RNG for generating a random number (or instructions for communicating with an RNG run on another device), game logic for determining the outcome based on the randomly generated number, and game assets (e.g., art, sound, etc.) for presenting the determined outcome to a player in an audio-visual manner. In some embodiments, the RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

The apparatus 300 may function as a computer terminal and/or server of an online casino or other entity operating to provide online games, receive and/or manage information related to online games. In some embodiments, the apparatus 300 may comprise a web server and/or other server device operable to accept wagers and determine random numbers based upon which outcomes for wagering games are determined. In some embodiments, the apparatus 300 may comprise an apparatus that is operable to interact with a player of an online game. In some embodiments, apparatus 300 may comprise a plurality of devices working together to accomplish the functionality described herein with respect to FIG. 3.

Any or all of the exemplary instructions and data types described herein and other practicable types of data may be stored in any number, type, and/or configuration of memory devices that is or becomes known. The memory device 308 may, for example, comprise one or more data tables or files, databases, table spaces, registers, and/or other storage structures. In some embodiments, multiple databases and/or storage structures (and/or multiple memory devices 308) may be utilized to store information associated with the apparatus 300. According to some embodiments, the memory device 308 may be incorporated into and/or otherwise coupled to the apparatus 300 (e.g., as shown) or may simply be accessible to the apparatus 200 (e.g., externally located and/or situated).

Example Interfaces

Figure 4A:
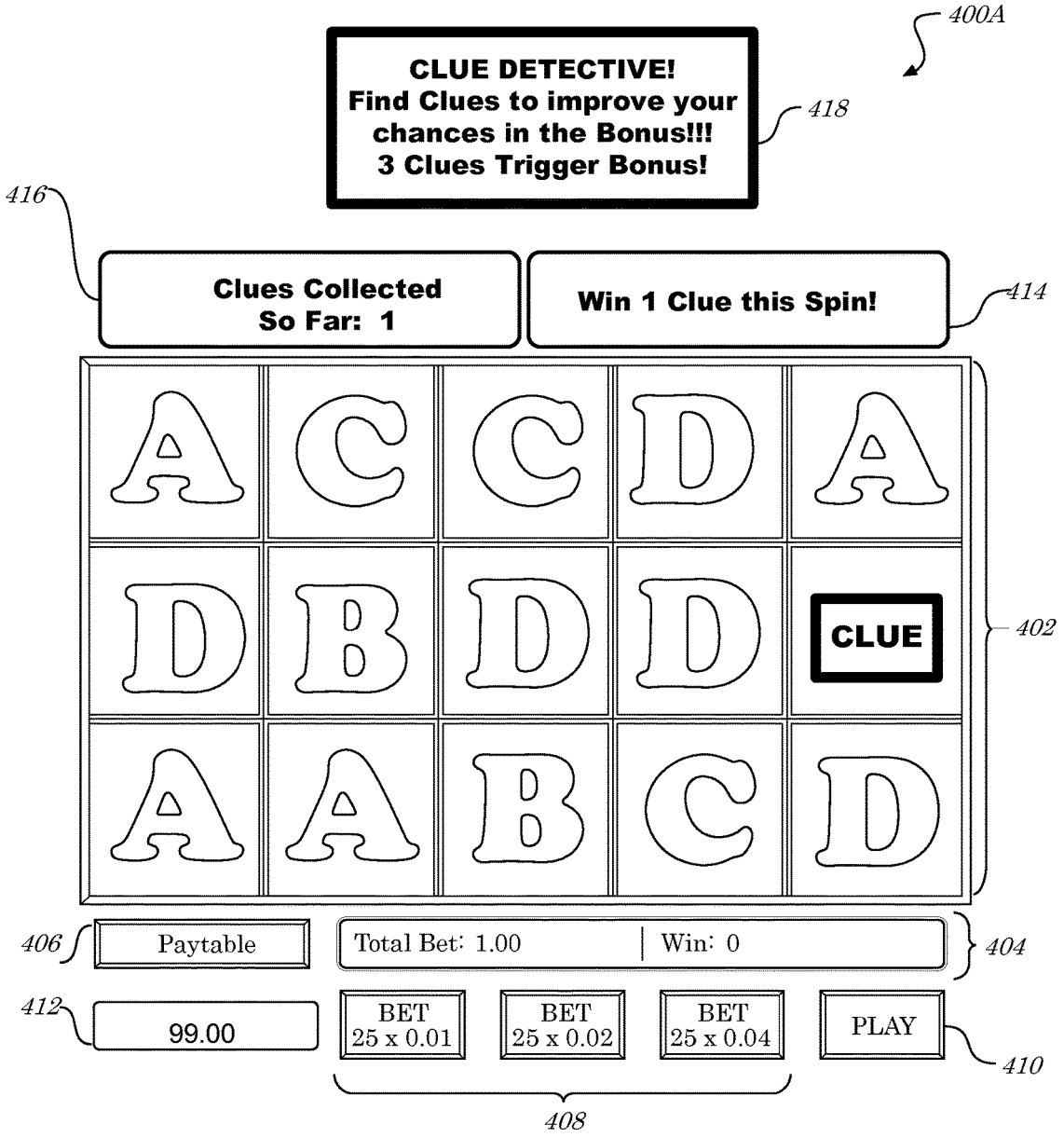
FIGS. 4A through 4C together illustrate one example embodiment of a game interface (e.g., a screen shot of an online game) for facilitating a primary aspect of a game, as it is modified based on events which occur in the primary game, in a manner consistent with one or more embodiments described herein.
Figure 4B:
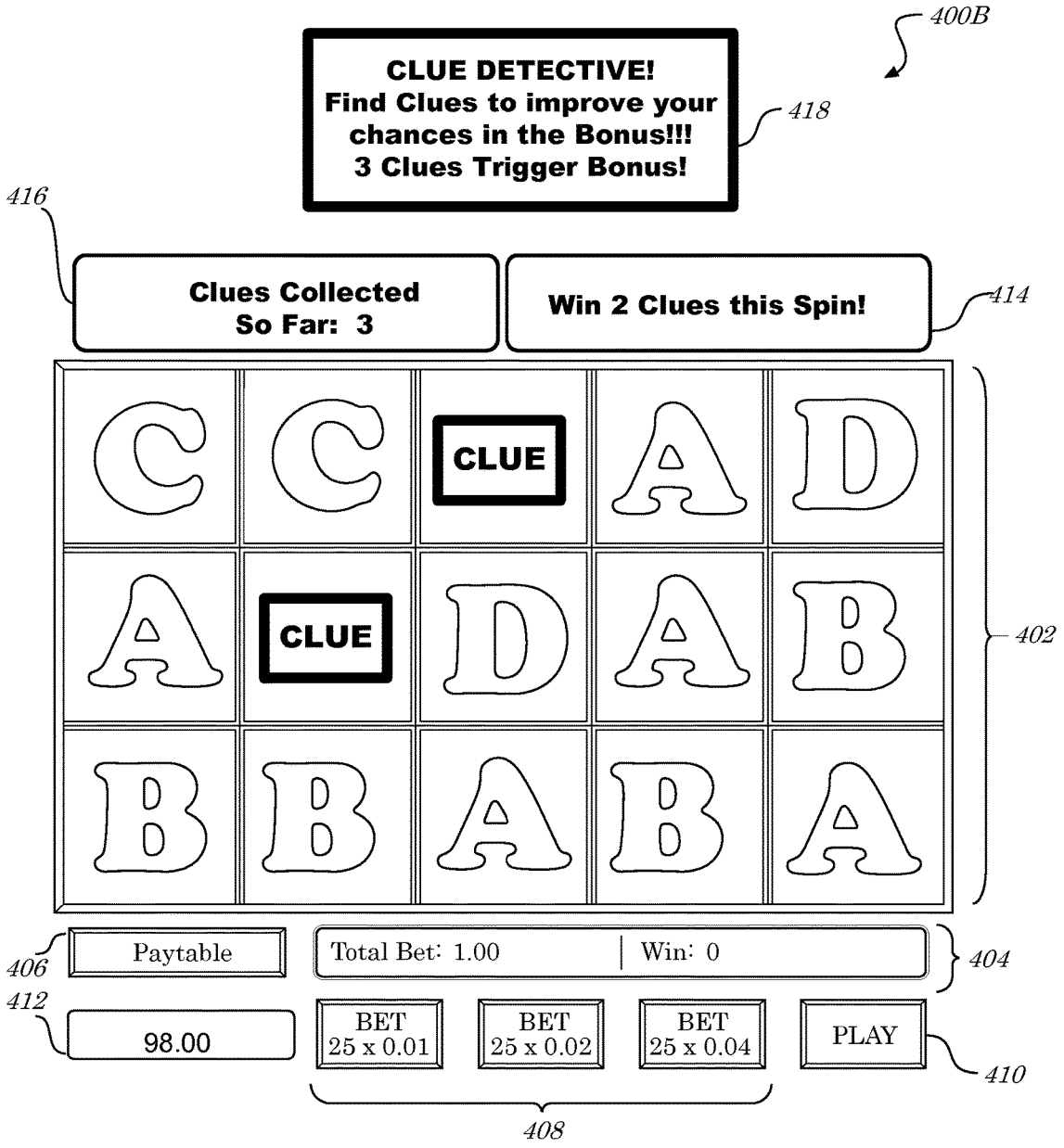
Figure 4C:
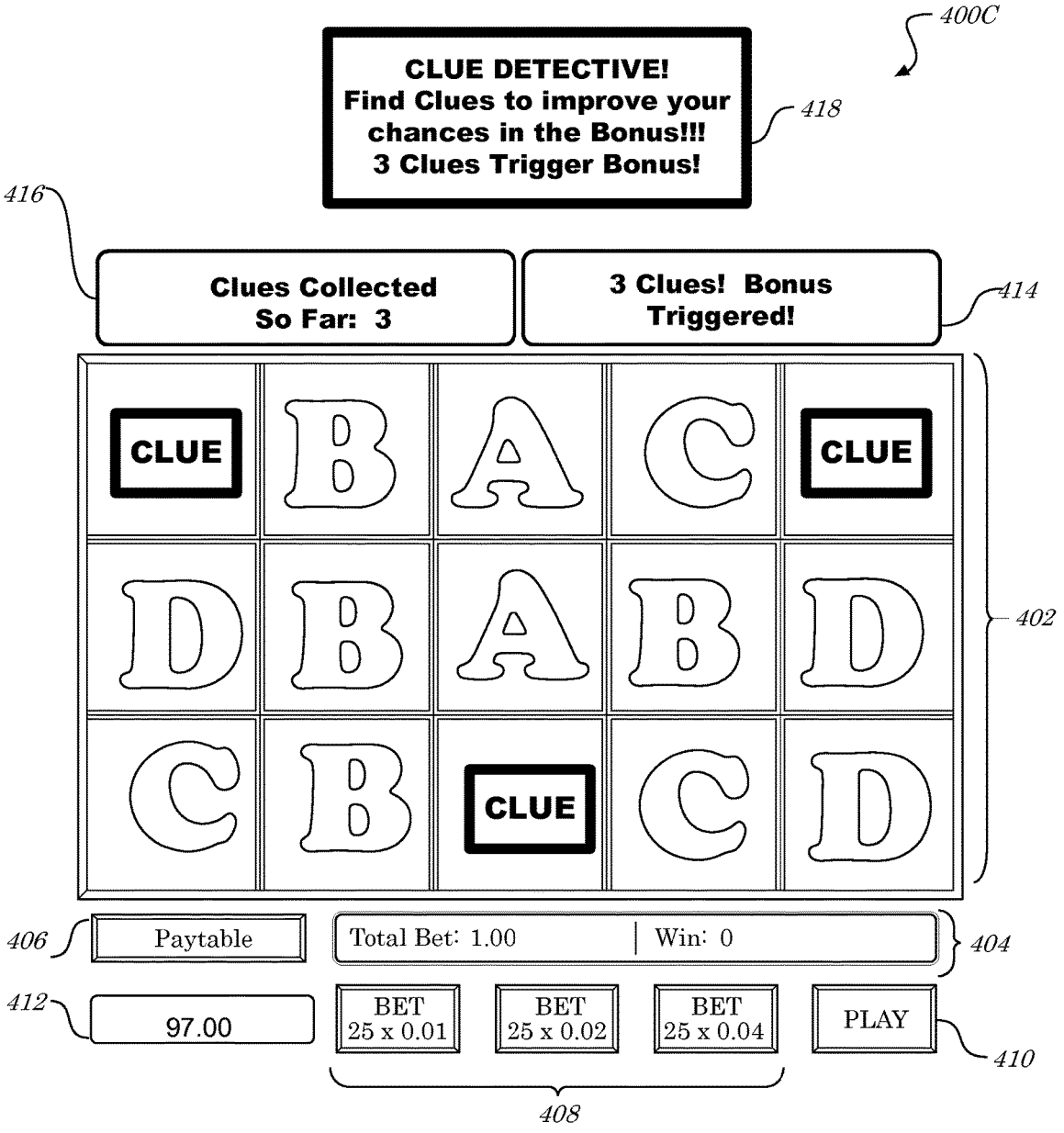

Turning now to FIG. 4A through 4C, illustrated therein is an example of a game interface 400 as it may be modified over the course of play of a primary game. In particular, FIG. 4A illustrates a representation of an example primary game interface as it may be output to a player who is initiating a new game session or has been returned to the primary game after playing a bonus round (e.g., and thus has used up any eliminator symbols previously collected by the player, in accordance with some embodiments). FIG. 4A is an illustration of a screen shot which represents a "snapshot in time" of a current status of a game event (e.g., the bet placed, the symbols comprising the outcome, any payout won as a result of the outcome), such as it may appear to a player once the reels of the game interface stop spinning, the game event comprising the spin is resolved and the symbols representing the outcome of the game event are output to the player.

The game represented in the game interface of FIGS. 4A through 4C consists of five vertical reels, with each reel having three symbol positions visible to a player of the game. Thus, the primary game represented in FIGS. 4A through 4C may be thought of as having a 3×5 symbol matrix (3 rows and 5 columns (reels)). Of course any number of reels or number of symbol positions on each reel may be utilized and the embodiments described herein are not dependent on any particular number or configuration of reels or symbol positions in a symbol matrix. Further, as described elsewhere herein, the embodiments described herein are not limited to a reeled slot machine game as the primary game and such is utilized in FIGS. 4A through 4C for illustrative purposes only. Many of the embodiments described herein may be applied to any game interface which includes symbols placed into symbol positions and a determination of whether any of the symbols output in the primary game are special symbols (e.g., eliminator symbols) which function to refine the player selectable elements made available for selection to a player during a bonus round (e.g., which function to eliminate previously determined symbols for the bonus round, such as bonus symbols representing sub-optimal results or prizes). For example, in a multi-hand card game in which a plurality of hands (e.g., a hand being a set of five cards) are arranged in rows of a symbol matrix, one embodiment may comprise outputting a symbol or card which functions as an eliminator symbol in one of the card positions of the symbol matrix. Other examples of different types of games to which the game mechanics described herein may be applied include, without limitation, bingo and keno.

For purposes of describing some embodiments, in the reel game interface of FIGS. 4A through 4C, the top visible symbol position of a given reel may be referred to as position "0" herein, the middle visible symbol position of a given reel may be referred to as position "1" herein and the bottom visible symbol position may be referred to as position "2" herein. Thus, for example, in FIG. 4A the game symbol "D" positioned in the middle position of the first reel may be referred as being in the "1" position of the first reel and the "Clue" symbol positioned in the middle position of the fifth reel may be referred to as being in the "1" position of the fifth reel.

Turning now to FIG. 4A in particular, the game interface 400A includes a plurality of areas for outputting information. It should be understood that these areas are merely one example embodiment and any other configuration or design of a primary game interface which allows for the output of eliminator symbols which may be collected or won by a player are within the scope of the invention(s) described herein.

Area 402 comprises an area for outputting a representation of an outcome for the primary game. The example primary game depicted in FIGS. 4A through 4C is an "A-B-C-D" themed game in which the regular symbols are "A", "B", "C" and "D" and an eliminator symbol ("Clue") may be placed in any of the symbol positions of the game interface. In some embodiments, an eliminator symbol may be placed in a symbol position over or along with a regular symbol, such that the eliminator symbol is taken into account for purposes of determining how many eliminator symbols are associated with the player and/or whether the bonus round has been triggered while the regular symbol may be taken into account in determining whether the player qualifies for a prize as a result of the outcome along a payline of the game interface. In some embodiments, an eliminator symbol may have dual functionality or effect (e.g., an eliminator symbol may also function as a wild or scatter symbol). Area 402 comprises a symbol matrix comprising a plurality of symbol positions arranged in a configuration of five (5) columns (e.g., reels) and three (3) rows. Each intersection of a row and column comprises a unique symbol position (e.g., reel position "0" of the first reel on the left is a symbol position which in FIG. 4A has the symbol "A" placed therein while reel symbol position "1" of the first reel on the left is a symbol position which in FIG. 4A has the symbol "D" placed therein).

It should be noted that the symbols to be output in the area 502 for a game event may be determined based on a pseudo-random process. For example, an RNG may be used to determine a random number which may then be used to determine the symbols to output in area 502. The RNG may be stored in, for example, a game server (e.g., game server 110 of FIG. 1), another server device in communication with a player device on which the game is being played or the player device itself. In some embodiments, the initiation of an event instance (e.g., a game event such as an initiation of a spin) or other request for an outcome of the game may cause the player device to request the outcome (or an RNG based upon which an outcome may be determined) from another device such as a game server (e.g., game server 110 of FIG. 1). Thus, in some embodiments when a player places a wager and initiates a game event (e.g., by actuating or selecting the "play" button or area 410), this may cause at least one of a result and an outcome for the game event to be determined. For example, at least one of the following may be determined as a result of a player actuating the "Play" command represented by the area 410: (i) whether a payout for the primary game is to be awarded to the player as a result of the game event; (ii) which symbol of a plurality of available symbols should be placed in each symbol position of the game matrix); (iii) how many eliminator symbols are to be awarded to the player as a result of the game event. Any or all of the foregoing may be determined by at least one of the player device and a remote server device, based on an RNG process or another process.

Area 404 of the screen interface outputs to the player (i) the total bet or wager being placed on the current game event; and (ii) the total win or payout won by the player as a result of the game event. In the example of FIG. 4A, it is shown that a total bet of 1.00 (e.g., credits, dollars or another currency) has been placed on the current game event and that the player has not won anything as a result of the game event. For purposes of simplicity, it is to be assumed that none of the outcomes illustrated in FIGS. 4A through 4C result in a payout for the primary game being awarded to the player, such that the description may better focus on some example implementations of eliminator symbols in accordance with some embodiments.

Area 406 of the game interface 400A, if actuated or selected by the player, will cause a paytable and/or other information explaining the rules or mechanics of the game to be displayed to the player (e.g., via a new screen or pop-up window). For example, a selection of area 406 by a player may cause a screen a payout table screen to be output to the player, informing the player of the paylines and payout schedule of the game.

Area 408 includes a selection of different bet amounts which a player may select for a given game event. For example, he player may choose to bet 0.25 (i.e., 25×0.01), 0.50 (i.e., 25×0.02), or 1.00 (i.e., 25×0.04). Of course, additional or different bet amounts may be used and the embodiments described herein are not limited to any particular bet amount or number of bet amounts. In some embodiments, a player may only be eligible to win or collect eliminator symbols by placing at least a minimum wager amount (e.g., by placing the maximum bet amount of the available bet amounts).

Area 412 indicates to the player the current amount of the player's credit balance. In the current example, the player has 99.00 credits available for wagering from the credit balance. A bet the player places may be deduced from the credit balance shown in area 412 and any payouts won by the player may be added to the credit balance shown in area 412.

Area 414 comprises an area for dynamically outputting messages to the player (e.g., messages of encouragement, status information and/or an explanation of a game event). In the example game instance illustrated in FIG. 4A, the player has won one (1) eliminator symbol as a result of the game event. The eliminator symbol is illustrated as being positioned in position "1" of the right-most reel. Area 414 informs the player that he has won the one (1) eliminator symbol (represented as a "Clue" symbol) as a result of the current game event or spin.

Area 416 comprises an area for dynamically outputting the number of eliminator symbols the player has won or collected thus far, which in accordance with some embodiments are available for use during the next bonus round triggered during the primary game. In the example game session illustrated in FIG. 4A, the player has collected one (1) eliminator symbol thus far (the Clue symbol won as a result of the current game instance). The number of eliminator symbols collected may, in accordance with some embodiments, be updated each time the player wins another eliminator symbol (and, in some embodiments, be reset down to zero (0) upon the occurrence of a predetermined event, such as returning to the primary game after the conclusion of a bonus round in which previously collected eliminator symbols were applied).

Area 418 comprises an area for outputting general information about the game, such as a title of the game and some general information about playing the game. The area 418 of FIG. 4A, for example, explains that finding "Clue" symbols improves the player's chances during the bonus and that the "Clue" symbols which appear as part of an outcome will cause the bonus round to be initiated.

Before continuing to a description of FIG. 4B it should be noted that, in the present application, like reference numerals in the Figures refer to like elements. Thus, for example, in the FIGS. 4A through 4C (which show a progression of primary game over the course of an initial spin and subsequent game spins), area 402 is repeated (although it may be shown to output different symbols in the symbol positions of the game matrix, based on an outcome of a spin or replacement of symbols). Similarly, areas 404, 406, 408, 410 and 412 are also repeated, although the information or data shown in them may change (e.g., the credit balance shown in area 412 is adjusted based on game events, such as wagers placed).

It should be noted that additional information may be output to the player via the interface illustrated in FIGS. 4A through 4C, which additional information is omitted herein for purposes of brevity. For example, player history or preferences, information about other games the player is participating in, recommendations or tips for betting, etc. may be show for one or more players.

Turning now to FIG. 4B, screen shot 400B (which shows the progress in the primary game since that shown in FIG. 4A) illustrates that the player has placed another 1.00 bet (as indicated in area 404) and has won, as a result of the game event for which the bet was placed (the spin of the reels in this example) an additional two (2) eliminator symbols. Specifically, the player has won the Clue symbol illustrated in position "1" of the second reel from the left and the Clue symbol illustrated in the "0" position of the third reel. Thus, the area 414 has been updated to indicate to the player that two (2) additional eliminator symbols (represented as the Clue symbols) have been won. Additionally, area 416 has been updated to reflect that the player now has collected three (3) eliminator symbols (the Clue symbol collected as a result of the outcome illustrated in FIG. 4A and the two Clue symbols collected as a result of the outcome illustrated in FIG. 4B). Finally, area 412 has been updated to reflect that the credit balance is now 98.00 credits after the 1.00 bet has been deducted from the previous balance (indicated in FIG. 4A) of 99.00.

Turning now to FIG. 4C, illustrated therein is a representation of a game interface or screen shot 400C (which shows the progress in the primary game since that shown in FIG. 4B). FIG. 4C illustrates that the player has placed another 1.00 bet (as indicated in area 404) and has won, as a result of the game event for which the bet was placed (the spin of the reels in this example) three (3) eliminator symbols. Specifically, the player has won the Clue symbol illustrated in position "0" of the first reel, the Clue symbol illustrated in position "2" of the third reel and the Clue symbol illustrated in position "0" of the fifth reel. In accordance with some embodiments, the appearance of a predetermined number of eliminator symbols (three (3) or more Clue symbols in the non-limiting example of FIGS. 4A through 4C) triggers an initiation of a bonus round (as indicated in area 418 of FIGS. 4A through 4C). The message in area 414 has been updated to indicate to the player that the three (3) eliminator symbols (represented as the Clue symbols) have caused the bonus round to be initiated.

In accordance with one embodiment, if an outcome comprises the predetermined number of eliminator symbols the corresponding award is entry into the bonus round without the eliminator symbols which triggered the bonus round being added to the running total of eliminator symbols collected by the player. The primary game embodied in FIG. 4C implements such an embodiment. Thus, the area 416 has not been updated to reflect the addition of the three Clue symbols output in area 402, which area still indicates that the player has collected three (3) eliminator symbols (the one Clue symbol collected as a result of the outcome illustrated in FIG. 4A and the two Clue symbols collected as a result of the outcome illustrated in FIG. 4B). In other embodiments, the eliminator symbols which qualify the player for the bonus round or the appearance of which as a result of a game event triggers a bonus round are also added to the running count of collected eliminator symbols (e.g., prior to the bonus round being initiated). Finally, area 412 has been updated to reflect that the credit balance is now 97.00 credits after the 1.00 bet has been deducted from the previous balance (indicated in FIG. 4B) of 98.00.

Figure 5A:
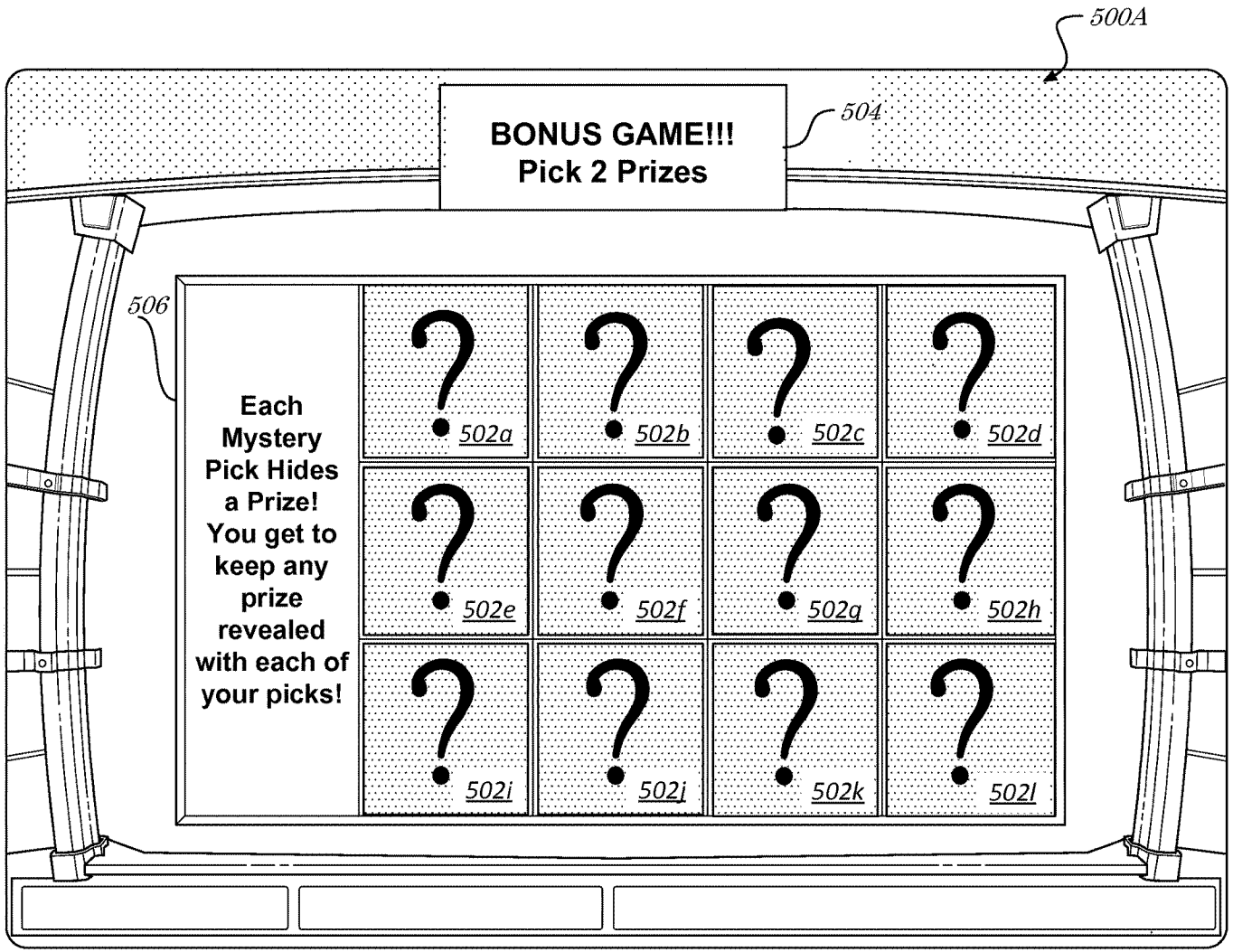
FIGS. 5A through 5C together illustrate one example embodiment of a game interface (e.g., a screen shot of an online game) for facilitating a bonus round of the game, as it may be output and modified based on events which occurred in the primary aspect of the game.
Figure 5B:
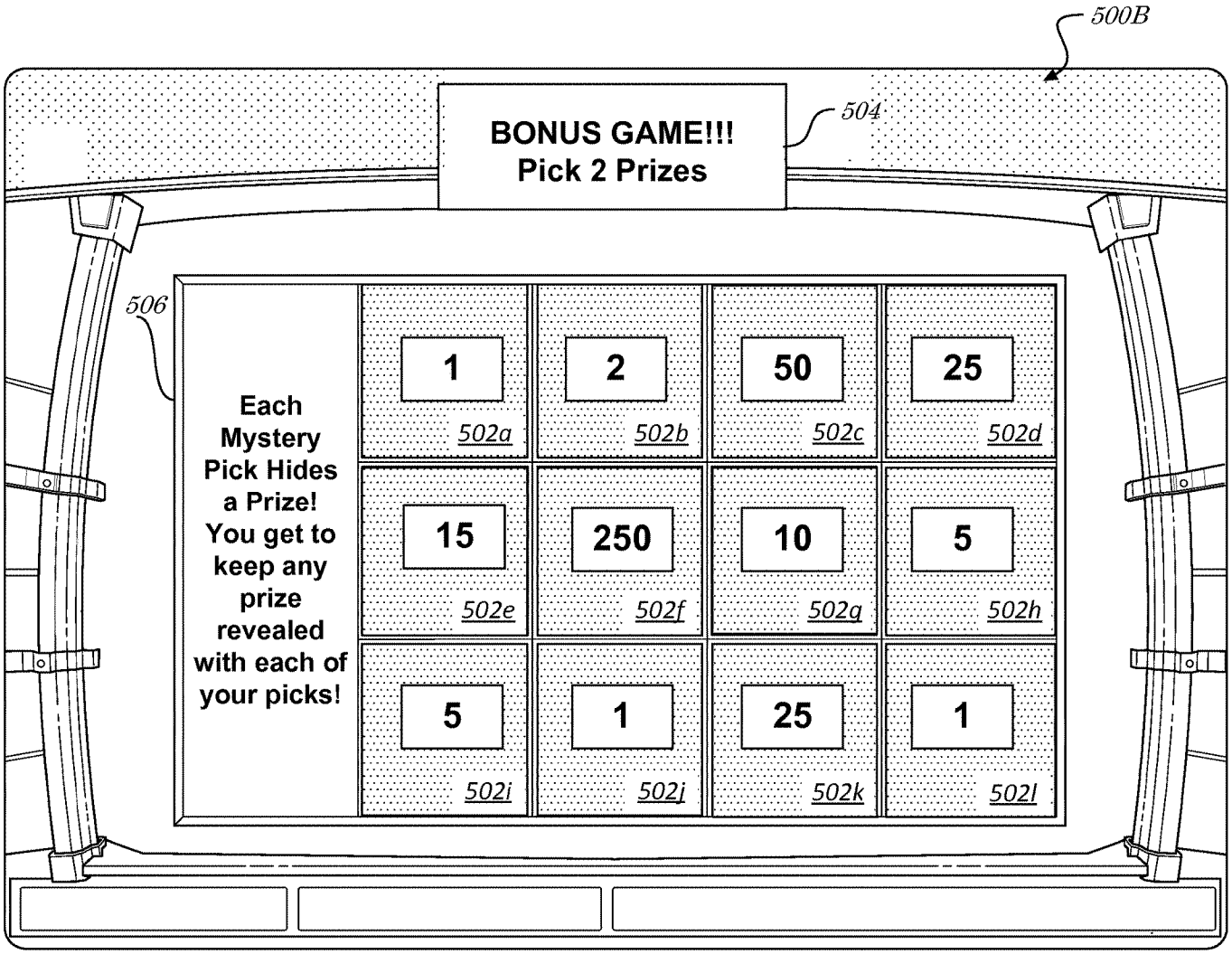
Figure 5C:
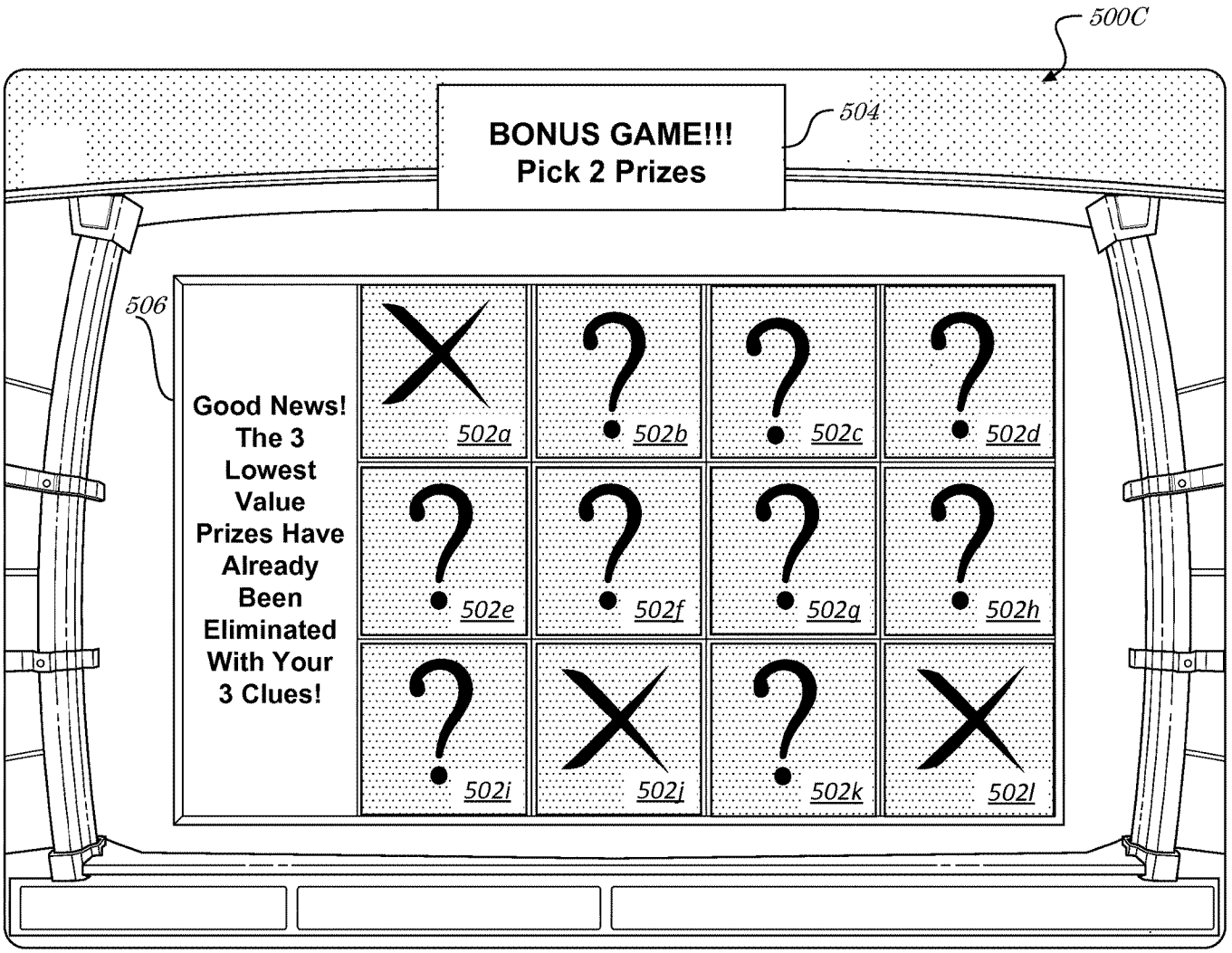

Turning now to FIGS. 5A-5C, illustrated therein is an example of a game interface 500 as it may be modified over the course of play of a bonus round. In particular, FIG. 5A illustrates a representation of an example bonus round game interface as it may be output to a player upon initiation of the bonus round, prior to any eliminator symbols being applied (or in a scenario in which the player has not collected any eliminator symbols and thus no player selectable elements have been eliminated from the selections available to the player). The game interface includes an area 504 for outputting information about the bonus round to the player. In the particular example bonus round of FIG. 5A, the player is instructed to select two of the player selectable elements 502*a* through 502*l*. Each of the player selectable elements 502*a* through 502*l* may, for example, correspond to an area of a touch screen or other mechanism for accepting input from a player, which may be selected by the player via a touch or other input.

In accordance with some embodiments, each of the question mark symbols depicted in FIG. 5A comprises a bonus round symbol representing a respective player selectable element. Each player selectable element represents a hidden or concealed prize of an amount of credits. Once the player selects a particular player selectable element of the player selectable elements 502*a* through 502*l* (and the player may pick two such player selectable elements in the example game represented in FIG. 5A), the value of the prize represented by the player selectable element is revealed to the player (and, in some embodiments, added to the player's credit balance for use by the player in playing the primary game and/or cashing out or transferring to another account). Area 506 of the bonus round interface 500A informs the player that, in accordance with the rules of the example bonus round represented in FIG. 5A, the player is awarded the value revealed by each player selectable element selected by the player.

In accordance with some embodiments, the value of the prize represented by a particular player selectable element may be predetermined (e.g., all values of all player selectable elements made available to the player during a bonus round may be determined prior to being output for selection to the player (e.g., based on a random or pseudo-random determination). In accordance with other embodiments, a value of a prize represented by a player selectable element may be determined dynamically (e.g., in response to the player selecting the subject player selectable element).

In accordance with some embodiments, the values of the player selectable elements for a bonus round are predetermined and stored prior to a bonus round being triggered during play of the primary game (e.g., upon a player initiating or restarting play of the primary game). Thus, for example, the array of player selectable elements output in FIG. 5A may comprise bonus round symbols which conceal a predetermined and stored value. Turning now to FIG. 5B, illustrated therein is another view of the array of player selectable elements from FIG. 5A, illustrating the predetermined and stored values that each of the bonus round symbols depicted in FIG. 5A conceals or is associated with. In accordance with some embodiments, the view of the player selectable elements of FIG. 5B would not be output to a player (although in some embodiments a view similar to the view of FIG. 5B, indicated the value represented by each bonus round symbol in the array of FIG. 5A, may be output after a player makes his selections, to show to the player all the values which had been available to the player as part of the array). FIG. 5B is a provided herein for illustrative purposes, to indicate one possible set of values which may be made available via bonus round symbols representing the player selectable elements and associated values. Thus, for example, the question mark symbol representing player selectable element 502*a* conceals or is associated with a value of one (1) credit, the question mark symbol representing the player selectable element 502*b* conceals or is associated with a value of two (2) credits, the question mark symbol representing player selectable element 502*c* conceals or is associated with a value of fifty (50) credits and so forth. As can be appreciated upon reviewing the values of the array in FIG. 5B, the highest value (250 credits) is associated with the player selectable element 502*f* and the three lowest values (of 1 credit each) are associated with player selectable elements 502*a*, 502*j* and 502*l*, respectively.

In accordance with some embodiments, the player elements representing the lowest available values (or most sub-optimal choices) are eliminated from the array of player selectable elements comprising a bonus round based on eliminator symbols collected by the player in a bonus round. Thus, assuming the example set of values [1, 1, 1, 2, 5, 5, 10, 15, 25, 25, 50, 250] having been generated or otherwise determined for the current bonus round, the values are arranged in order from lowest to highest to show which values would be eliminated first. In other embodiments, another criteria may be used for determining which player selected elements to eliminate and the embodiments described herein are not limited to any particular criteria for determining which player selectable elements to eliminate (such as lowest value elements to be eliminated first). In one embodiment, at least some of the player selected elements may have similar or equal value (e.g., as the "1" value elements do in the example of FIG. 5B or as may be the case in which the player selectable elements represent answers to a riddle, mystery, trivia question or other inquiry and certain of the answers are wrong and thus effectively of the same value).

Turning now to FIG. 5C, illustrated therein is a representation of a bonus round game interface or screen shot 400C (which shows the progress in the bonus round since that shown in FIG. 5A). In the example embodiment illustrated, the three eliminator symbols earned by the player in the primary game (as illustrated in FIG. 4C) cause the 3 lowest values (the "1" values) to be eliminated or be rendered unavailable for player selection during the bonus round. As described with respect to FIG. 5B, the three lowest value elements are represented by player selectable elements 502*a*, 502*j* and 502*l*, respectively. Thus, the bonus round game interface 500C indicates to the player which three player selectable elements are not available for selection (via the output of "X" symbols in place of the question mark symbols in player selectable elements 502*a*, 502*j* and 502*l*, respectively. Of course, any mechanism for informing the player of the unavailability of certain player selectable elements may be employed. Alternatively, a smaller array of player selectable elements may simply be output to the player for the bonus round, with the eliminated player selectable elements being omitted entirely rather than being indicated in some fashion as no longer being available for selection.

A comparison of the set of values represented in the view of the player selectable elements in FIG. 5B indicates that the remaining values which remain available for player selection comprise [2, 5, 5, 10, 15, 25, 25, 50, 250]. Accordingly, a result of the elimination of the lowest value player selectable elements is that the player has an increased chance of selecting a higher value player selectable element. Another result is that the lowest available prize is now two (2) credits rather than one (1) credit. Area 506 has also been updated to inform the player that the three (3) lowest value player selectable elements have been removed as a result of the three (3) eliminator symbols collected by the player during the primary game.

In one alternate embodiment, rather than rendering player selectable elements unavailable for selection, a special symbol such as an eliminator symbol may function to cause certain player selectable elements to be indicated as undesirable to a player. For example, a visual display (e.g., a visual display of a bonus round symbol representing such a sub-optimal player selectable element) may be altered to indicate to a player which of the player selectable elements are undesirable (e.g., are associated with the lowest value prize(s), incorrect answer(s), "end-game or "pooper" symbols which function to end a bonus round if selected, or any other player selectable element in a bonus round which is a sub-optimal choice for the player). In one embodiment, the low value or incorrect answer associated with a sub-optimal player selectable element may be displayed to a player such that the player is discouraged from selecting that player selectable element. As with the embodiments involving removal or rendering unavailable for selection a player selectable element, altering a visual display to indicate that one particular player selectable element is undesirable or sub-optimal without actually making it unavailable for selection or removing it from the plurality of available player selectable elements may be done for each eliminator symbol won by the player during the primary game.

Although a plurality of player selectable elements available for selection by a player is illustrated in FIGS. 5A through 5C in a grid configuration, any configuration or visual depiction of player selectable elements may be utilized. For example, player selectable elements may be embodied as moving objects in a scene which a player may select or attempt to select (e.g., by "shooting" them with a virtual ray gun in an outer space-themed bonus round).

Figure 6:
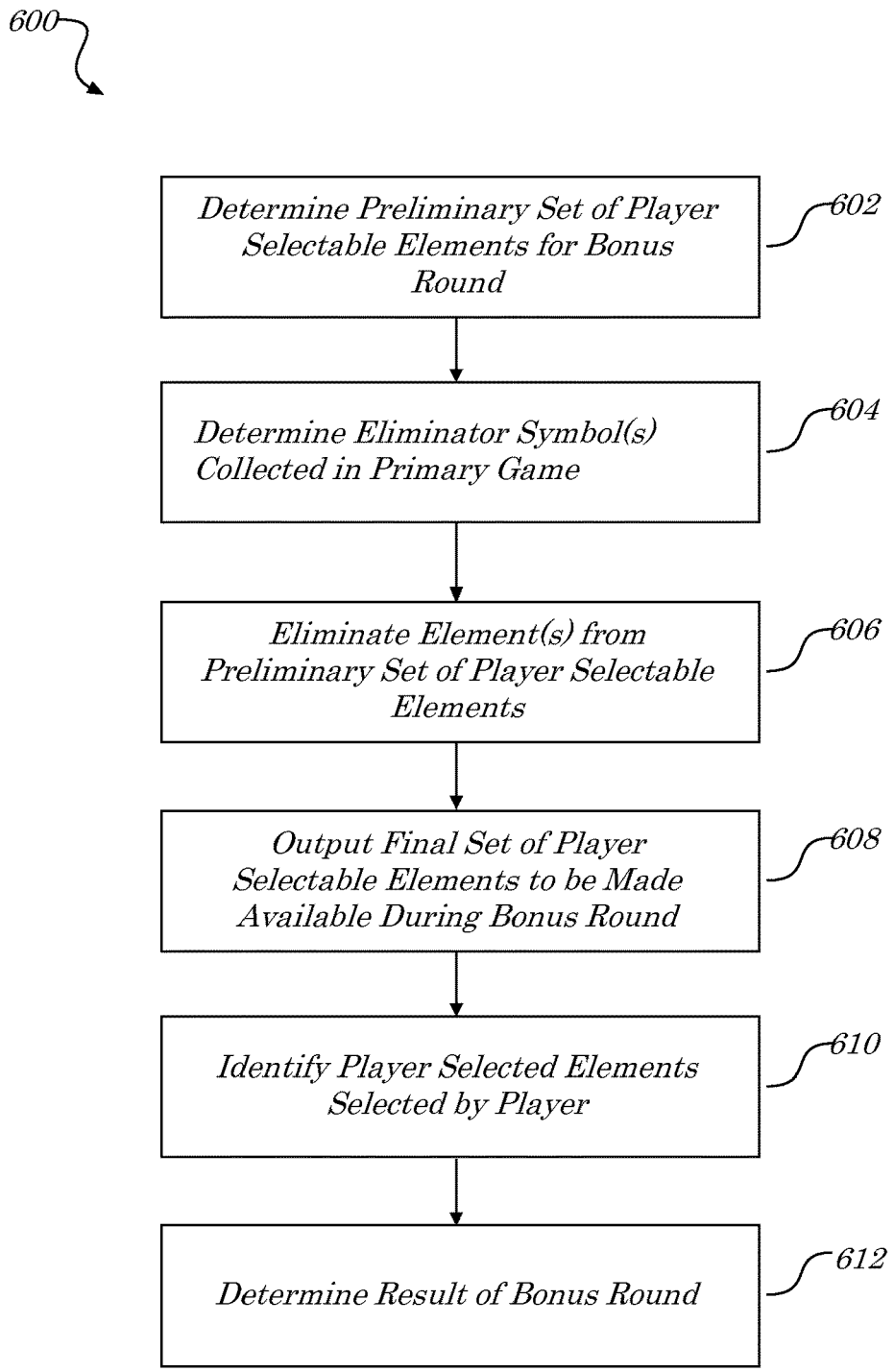
FIG. 6 is a flowchart of an example process consistent with one or more embodiments described herein.

Turning now to FIG. 6, illustrated therein is a flowchart of an example process 600, which is consistent with some embodiments described herein. Process 600 comprises a process for implementing the functionality of at least one eliminator symbol. In one embodiment, at least a portion of process 600 may be performed in response to an initiation of a bonus round. In one embodiment, at least a portion of process 600 may be performed as a background process for modifying the player selectable elements to be made available in a bonus round once it is initiated but while the primary game is still in progress. The processes 600 may be performed, for example, by at least one of a server device operable to facilitate an electronic (e.g., online) game and/or a player device enabling a player to play the electronic (e.g., online) game. For example, the process 600 may be performed by at least one of (i) a player device 102 (FIG. 1); (ii) a game server 110 (FIG. 1); (iii) a player device 202 (FIG. 2); (iv) a game server 210 (FIG. 2); and (v) apparatus 300 (FIG. 3). Additional and/or different steps may be added to those depicted. Not all steps depicted are necessary to any embodiment described herein. Process 600 may comprise a subroutine of a more general program. In one embodiment, process 600 may comprise at least a part of bonus round program 310*b* (FIG. 3). The process 600 is an example processes of how some embodiments described herein may be implemented, and should not be taken in a limiting fashion. A person of ordinary skill in the art, upon contemplation of the embodiments described herein, may make various modifications to process 600 without departing from the spirit and scope of the embodiments in the possession of applicants.

Process 600 begins in step 602 with a determination of a preliminaty set of player selectable elements for a bonus round. The determination of a preliminary set of player selectable elements may comprise determining the values to be associated with each player selectable element. This may comprise generating such values or requesting the values from another device (E.g., a server which comprises an RNG usable for generating such values). In one embodiment, determining the values may comprise retrieving the set of values from a memory (e.g., a database stored at the device performing process 600 or another device), which set of values may have previously been generated or otherwise determined as a set of preliminary values to use for a bonus round. In one embodiment step 602 may further comprise determining a bonus round symbol for each player selectable element (e.g., a bonus round symbol to represent each player selectable element).

In some embodiments, a game may comprise different types of player selectable elements. For example, in a CLUE™ themed game, there may be one set of player selectable elements for the "Who?" category, another set of player selectable elements for the "Weapon?" category and still another set of player selectable elements for the "Room?" category. In such embodiments, a player may need to select a correct or winning combination of player selectable elements (e.g., one correct answer from each type or category) in order to win a prize for the bonus round. In another embodiment, different types of player selectable elements may be mixed up in a grid or other configuration. For example, there may be multiplier elements (which, if selected by the player, function to multiply a prize associated with the player), game ending elements (which, if selected by the player, function to end the bonus round), free spin elements (which, if selected by the player, function to award the player a number of free spins or game initiations of the primary game or bonus round). In embodiments which comprise different types of player selectable elements, step 602 may comprise determining at least one of (i) which types of player selectable elements are to be included in the bonus round; (ii) how many of each type of player selectable element is to be included in the bonus round; (iii) the value of each player selectable element of each type to be included (e.g., if a plurality of multiplier elements are to be included, step 602 may comprise determining the multiplier value for each; if a plurality of free spins elements are to be included, step 602 may comprise determining the number of free spins to be associated with each such element, etc.).

In some embodiments, step 602 may further comprise determining a placement or location for each player selectable element of the preliminary set of player selectable elements (e.g., into which location of a grid configuration each determined player selectable element is to be placed). In other embodiments, steps 602 through 608 of process 600 may be performed prior to a placement or determination of placement of the player selectable elements (whether in the preliminary set or the final set).

In step 604, the eliminator symbol(s) collected by a player during play of the primary game are determined. This may comprise determining at least one of (i) the number of eliminator symbols; and (ii) the type of each eliminator symbol (if more than one type is available in the game). In one embodiment, steps 602 through 606 are performed upon each outcome of a primary game which includes at least one eliminator symbol and thus step 602 may comprise determining the eliminator symbols collected in the most recent outcome of the primary game. This may mean that steps 602-606 are repeated for each outcome of the primary game which includes at least one eliminator element and steps 608-612 are performed once the bonus round is initiated (and may not be performed if the player currently playing the primary game ends play of the game prior to qualifying for the bonus round). In another embodiment, steps 602 through 606 are not performed until a bonus round is initiated, in which case step 602 may include determining all the eliminator symbols collected during play of the primary game since it was started or last reset.

In step 606 the appropriate player selectable elements are eliminated from the preliminary set of player selectable elements. Eliminating a player selectable element may comprise, depending on the embodiment, (i) removing the player selectable element and/or the bonus round symbol representing the player selectable element from a visual display of player selectable elements which are output to a player once the player qualifies for the bonus round; (ii) rendering the player selectable element as unavailable for selection by the player during the bonus round (even if the player selectable element is still visible or present to some extent in the visual display of player selectable elements), such as by graying out or otherwise modifying the appearance of a bonus round symbol representing the player selectable element or replacing the bonus round symbol which represents player selectable elements available for selection with a bonus round symbol which represents player selectable elements not available for selection; or (iii) displaying an indication to the player (discernable or viewable by the player once the player qualifies for the bonus round and is provided with a visual display of the player selectable elements comprising the bonus round) that the player selectable element is undesirable or sub-optimal. For example, with respect to option (iii), the value or another characteristic associated with the player selectable element may be revealed to the player (e.g., if the player selectable element is associated with an incorrect answer to a trivia or other question, an indication that the answer associated with that player selectable element is incorrect may be output; or a "low value" or similar indicator may be output in association with the player selectable element).

In accordance with one embodiment, there is a one-to-one correspondence between the eliminator symbols collected and the player selectable elements removed or otherwise rendered unavailable for selection (i.e., one player selectable element is eliminated for each eliminator symbol collected). Thus, in such embodiments step 606 may comprise eliminating one player selectable element for each eliminator element determined in step 604. In other embodiments, there may be an n-to-one, n-to-n, or one-to-n correspondence (wherein n represents any desirable number).

In embodiments in which there are different types of eliminator symbols and/or different types of player selectable elements, step 606 may further comprise determining which player selectable element to eliminate based on the type(s) of eliminator symbols collected and/or the types of player selected elements included in the preliminary set determined in step 602. For example, if an eliminator symbol is a "multiplier" type of eliminator symbol which functions to eliminate a multiplier player selectable element, step 606 may comprise determining which player selectable element is a multiplier element and eliminating that player selectable element.

In some embodiments, step 606 may comprise selecting which player selectable element to eliminate from a plurality of candidates (the player selectable elements which have not yet been eliminated but which qualify for possible elimination based on the function of the eliminator symbol being currently effectuated) of player selectable elements. For example, if the rules of the game dictate that the lowest value player selectable element is to be eliminated (or that the player selectable elements are to be eliminated based on the values associated therewith, from lowest to highest), step 606 may comprise determining which player selectable element of the candidates has the lowest value. In an embodiment in which multiple types of player selectable elements are available and it is determined that a multiplier type of element is to be eliminated (e.g., based on the determination in step 604), step 606 may comprise determining the multiplier elements still available for selection (e.g., after any previous implementation of eliminator symbols earlier in the process for the current bonus round) and selecting the multiplier element with the lowest multiplier value for elimination. Similarly, if it is determined that a free spins type of element is to be eliminated, step 606 may comprise determining the free spins elements still available and eliminating the player selectable element associated with the smallest number of free spins.

In some embodiments, step 606 may comprise determining a location (e.g., in a grid configuration of a bonus round) of the player selectable element(s) to be eliminated. For example, in one embodiment the preliminary set of player selectable elements determined in step 602 may be mapped onto a grid or other configuration of a bonus round and an indication of the location of each respective player selectable element (e.g., along with its type and/or value) may be stored (e.g., in a database or other memory mechanism accessible to the device performing step 606 of process 600). In such an embodiment, step 606 may comprise determining the location, from the memory, of the player selectable element(s) selected for elimination.

In step 608, the final set of player selectable elements to be made available for selection to the player is output to the player via an interface of the bonus round. The final set may comprise the preliminary set of player selectable elements determined in step 602 less the eliminated player selectable elements determined in step 606. In one embodiment, outputting the final set of player selectable elements comprised outputting each of the player selectable elements of the preliminary set of player selectable elements, but with the eliminated elements depicted in a visually differentiating manner such that the bonus round interface identifies to the player the eliminated elements. For example, the eliminated player selectable elements may be (i) represented with different bonus round symbols (than the bonus round symbols representing the player selectable elements available for selection by the player), (ii) represented in a different font, size and/or color (than the bonus round symbols representing the player selectable elements available for selection by the player) and/or (iii) output in association with a message or other indicator that the eliminated elements are not available for selection and/or are undesirable for selection.

In step 610 the player selectable elements selected by the player are identified. This may comprise determining, based on an input of the player (e.g., using a touch screen, mouse or other input device) which player selectable element(s) of the player selectable elements available for selection the player has selected. Step 610 may comprise, for example, determining the location(s) of the bonus round interface selected by the player and determining the player selectable elements associated with those locations. The result of the bonus round is then determined in step 612, based on the player selectable elements identified in step 610. For example, the value of each selected player selectable element may be determined. Any additional functionality of the player selectable element may also be implemented (e.g., if a player selectable element is a multiplier value, the appropriate multiplier may be applied to a prize value associated with the player; if the player selectable element is a number of free spins, the associated number of free spins may be added to a free spins tracking meter). In some embodiments, the player may be allowed to keep selecting player selectable elements until a predetermined condition is satisfied (E.g., a predetermined amount of time or selections occurs or the player selects an "end bonus round" element). In such embodiments, step 612 may further comprise determining whether the bonus round has ended and, if so, returning the player to play of the primary game.

As can be appreciated from the description of FIGS. 4A through 4C, FIGS. 5A through 5C and FIG. 6, according to one embodiment, systems, computer-readable media and methods for playing a game (e.g., a wagering game) provide for conducting a basic or primary game and a bonus game (also referred to as a bonus round or secondary aspect of the game) playable via a player device (e.g., a player device 102, as described with respect to FIG. 1). As illustrated in the example of FIGS. 4A through 4C, the primary game may comprise outputting one or more outcomes, each outcome comprising at least one game symbol that indicates a randomly selected outcome that has been selected from a plurality of outcomes in response to an input by a player (e.g., a wager input). In accordance with some embodiments, the outcomes of the primary game may include one or more special symbols which function to modify the bonus round of the game. In one embodiment, such a special symbol is an eliminator symbol which functions to eliminate one or more player selectable elements from a bonus round array of player selectable elements. Upon achieving an outcome which causes activation of a bonus round (e.g., as a randomly selected outcome in the primary game), a bonus round interface is output to the player. The bonus round interface may comprise a plurality of player selectable elements. In accordance with some embodiments, at least some of the player selectable objects are associated with a bonus award (in some embodiments at least one of the player selectable elements is not associated with an award). In accordance with some embodiments, the systems and methods may provide tier receiving a selection of at least one of the plurality of player selectable elements, displaying the bonus award associated with at least each of the selected player selectable elements (in some embodiments the systems, computer-readable media and methods may provide for revealing the bonus award associated with at least one non-selected player selectable element, even if that bonus award is not to be provided to the player). Thus, if presented with a bonus round interface such as that illustrated in FIG. 5A, the player may be invited to select at least one of the player selectable elements from the plurality of available player selectable elements presented in the interface. By way of example, the player's selections may occur one-at-a-time, with a reveal of the associated award for a selected element prior to the next selection, or all at once followed by a reveal of all the associated awards associated with the plural selections.

Applicants recognize that certain types of "pick bonuses" are available in some bonus rounds, wherein a player "picks" or selects a representation of a bonus award from a plurality of available representations of bonuses in a bonus round (e.g., a bonus round in which a player has an opportunity to select or pick possible outcomes or prizes the values of which are in some manner concealed from the player until the player selects them). Some of the values so represented may have a higher value prize associated therewith while others have a lower value prize or no prize associated therewith. In such games, the embodiments described herein could be applied to enhance such games by allowing a player (e.g., through play of the primary game) to narrow the bonus round selections made available to the player (e.g., by removing some of the choices, such as the lower value choices) via bonus round symbols which may be obtained or won by the player during the primary game and function to remove such choices from a list or set of choices to be presented to the player once the bonus round is triggered. In accordance with some embodiments, if play of a primary game serves to remove all choices except for one (or, in embodiments involving a plurality of choices, all except for one in each such category), the player may be automatically awarded a prize associated with such choice without having to play the bonus round.

It should be noted that the embodiments described herein are not limited to application in bonus rounds comprising player selectable elements or player selectable elements the values of which are concealed until selected by a player. For example, in one embodiment the embodiments described herein may be applied to a bonus round in which one or more possible bonus round elements are randomly selected for a player once the player enters a bonus round, by utilizing eliminator symbols won in the primary game which function to eliminate sub-optimal or low value elements prior to the selection being made.

Rules of Interpretation

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

The Title (set forth at the beginning of the first page of this disclosure) is not to be taken as limiting in any way as the scope of the disclosed invention(s).

The term "product" means any machine, manufacture and/or composition of matter as contemplated by 35 U.S.C. § 101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "and/or", when such term is used to modify a list of things or possibilities (such as an enumerated list of possibilities) means that any combination of one or more of the things or possibilities is intended, such that while in some embodiments any single one of the things or possibilities may be sufficient in other embodiments two or more (or even each of) the things or possibilities in the list may be preferred, unless expressly specified otherwise. Thus for example, a list of "a, b and/or c" means that any of the following interpretations would be appropriate: (i) each of "a", "b" and "c"; (ii) "a" and "b"; (iii) "a" and "c"; (iv) "b" and "c"; (v) only "a"; (vi) only "b"; and (vii) only "c."

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device, component or article is described herein, more than one device, component or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component or article is described herein (whether or not they cooperate), a single device, component or article may alternatively be used in place of the more than one device, component or article that is described. For example, a plurality of computer-based devices may be substituted with a single computer-based device. Accordingly, the various functionality that is described as being possessed by more than one device, component or article may alternatively be possessed by a single device, component or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, Digital Light Processing (DLP), rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as Standard Definition Television (SDTV), Enhanced Definition TV (EDTV), High Definition TV (HDTV), or the like. The information may likewise be static, in which case, painted glass may be used to form the display. Note that static information may be presented on a display capable of displaying dynamic information if desired. Some displays may be interactive and may include touch screen features or associated keypads as is well understood.

The present disclosure may refer to a "control system" or program. A control system or program, as that term is used herein, may be a computer processor coupled with an operating system, device drivers, and appropriate programs (collectively "software") with instructions to provide the functionality described for the control system. The software is stored in an associated memory device (sometimes referred to as a computer readable medium or an article of manufacture, which may be non-transitory in nature). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, Central Processing Unit (CPU) devices, computing devices, microcontrollers, digital signal processors, or like devices. Exemplary processors are the INTEL PENTIUM or AMD ATHLON processors.

The term "computer-readable medium" refers to any statutory medium that participates in providing data (e.g., instructions) that may be read by a computer, a processor or a like device. Such a medium may take many forms, including but not limited to non-volatile media, volatile media, and specific statutory types of transmission media. Non-volatile media include, for example, optical or magnetic disks and other persistent memory. Volatile media include DRAM, which typically constitutes the main memory. Statutory types of transmission media include coaxial cables, copper wire and fiber optics, including the wires that comprise a system bus coupled to the processor. Common forms of computer-readable media include, for example, a floppy disk, a flexible disk, hard disk, magnetic tape, any other magnetic medium, a CD-ROM, Digital Video Disc (DVD), any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read. The terms "computer-readable memory", "article of manufacture" and/or "tangible media" specifically exclude signals, waves, and wave forms or other intangible or non-transitory media that may nevertheless be readable by a computer.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Bluetooth™, Time Division Multiple Access (TDMA), Code Division Multiple Access (CDMA), Global System for Mobile communications (GSM), Enhanced Data rates for GSM Evolution (EDGE), General Packet Radio Service (GPRS), Wideband CDMA (WCDMA), Advanced Mobile Phone System (AMPS), Digital AMPS (D-AMPS), IEEE 802.11 (WI-FI), IEEE 802.3, SAP, the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium and/or memory for performing the process. The apparatus that performs the process can include components and devices (e.g., a processor, input and output devices) appropriate to perform the process. A computer-readable medium can store program elements appropriate to perform the method.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

What is claimed is:

1. A system for facilitating an electronic game, comprising:

a game server cluster operable to communicate with a plurality of player gaming devices through a load balancer;

a cloud-based cache cluster operable to store real-time game state data for a plurality of online games and further operable to communicate with the game server cluster;

the game server cluster being operable to serve a plurality of distinct game instances for each of a plurality of different online games to any of the plurality of player gaming devices by serving game outcomes to the plurality of player gaming devices by determining such outcomes using data received from a random number generator, wherein at least one game server of the game server cluster comprises:

a processor; and a memory storing a program for directing the processor, the processor being operable with the program to:

facilitate play of a distinct online game instance comprising a primary game and a bonus round, wherein outcomes of the primary game may include at least one eliminator symbol which, if won by a player playing the primary game, causes a state of at least one player selectable element of a plurality of player selectable elements comprising the bonus round to be modified, by:

determining that an outcome of the primary game includes at least one eliminator symbol;

determining that the bonus round has been triggered during play of the primary game;

determining a number of eliminator symbols collected by the player during the primary game since a previous bonus round, thus determining a number of player-selectable elements to be eliminated from the plurality of player selectable elements to be made available to the player during the bonus round; and causing, as a result of the at least one eliminator symbol being included in the outcome of the primary game and for each eliminator symbol collected by the player during the primary game since the previous bonus round, a sub-optimal player selectable element of the plurality of player selectable elements to be eliminated, prior to selection by the player of any of the plurality of player selectable elements, as a choice from the plurality of player selectable elements during the bonus round.

2. The system of claim 1, wherein the processor is further operable with the program to:

select which player selectable element of the plurality of player selectable elements is to be eliminated, thereby selecting the sub-optimal player selectable element.

3. The system of claim 2, wherein the processor is further operable with the program to:

determine a respective value associated with each player selectable element of the plurality of player selectable elements;

determine which value of the respective values is a lowest value; and select, as the sub-optimal player selectable element to be eliminated, a player selectable element associated with the lowest value.

4. The system of claim 3, wherein the processor is further operable with the program to:

determine that the lowest value is associated with more than one of the plurality of player selectable elements; and select one of the more than one of the plurality of player selectable elements associated with the lowest value as the sub-optimal player selectable element to be eliminated.

5. The system of claim 4, wherein the processor being operable with the program to select one of the more than one of the plurality of player selectable elements associated with the lowest value as the sub-optimal player selectable element to be eliminated comprises the processor being operable with the program to randomly select one of the more than one of the plurality of player selectable elements associated with the lowest value as the sub-optimal player selectable element to be eliminated.

6. The system of claim 1, wherein causing the sub-optimal player selectable element of the plurality of player selectable elements to be eliminated, prior to the selection by the player, as a choice from the plurality of player selectable elements comprises causing the sub-optimal player selectable element to be removed from the plurality of player selectable elements output to the player for selection during the bonus round.

7. The system of claim 1, wherein causing the sub-optimal player selectable element of the plurality of player selectable elements to be eliminated, prior to the selection by the player, as a choice from the plurality of player selectable elements comprises causing the sub-optimal player selectable element to be associated with a different visual indicator than a remainder of the plurality of player selectable elements.

8. The system of claim 7, wherein the different visual indicator comprises at least one of a different font, size, color and bonus round symbol.

9. The system of claim 1, wherein causing the sub-optimal player selectable element of the plurality of player selectable elements to be eliminated, prior to the selection by the player, as a choice from the plurality of player selectable elements during the bonus round comprises altering a visual indicator of the sub-optimal player selectable element such that an unavailability of the sub-optimal player selectable element is indicated to the player.

10. The system of claim 1, wherein the processor is further operable with the program to facilitate the electronic game by:

determining a type of eliminator symbol included in the outcome, wherein the electronic game includes a plurality of types of eliminator symbols as available for being included in an outcome of the primary game, each type of eliminator symbol being associated with a type of player selectable element;

determining, based on the type of eliminator symbol, a type of player selectable element to be modified in the bonus round; and wherein causing the sub-optimal player selectable element of the plurality of player selectable elements to be eliminated, prior to selection by the player, as a choice from the plurality of player selectable elements during the bonus round comprises causing the sub-optimal player selectable element determined to be associated with the type of eliminator symbol included in the outcome to be eliminated.

11. A non-transitory computer-readable medium storing instructions for directing a processor to facilitate play of a game comprising a primary game and a bonus round, wherein outcomes of the primary game may include at least one eliminator symbol which, if won by a player playing the primary game, causes a state of at least one player selectable element of a plurality of player selectable elements comprising the bonus round to be modified, by:

determining that an outcome of the primary game includes at least one eliminator symbol;

determining that the bonus round has been triggered during play of the primary game;

determining a number of eliminator symbols collected by the player during the primary game since a previous bonus round, thus determining a number of player-selectable elements to be eliminated from the plurality of player selectable elements to be made available to the player during the bonus round; and causing, as a result of the eliminator symbol being included in the outcome of the primary game and for each eliminator symbol collected by the player during the primary game, a player selectable element of the plurality of player selectable elements to be eliminated, prior to selection by the player, as a choice from the plurality of player selectable elements during the bonus round.

12. The non-transitory computer-readable medium of claim 11, wherein causing the player selectable element of the plurality of player selectable elements to be eliminated, prior to the selection by the player, as the choice from the plurality of player selectable elements comprises causing the player selectable element to be removed from the plurality of player selectable elements output to the player for selection during the bonus round.

13. The non-transitory computer-readable medium of claim 11, wherein causing the player selectable element of the plurality of player selectable elements to be eliminated, prior to the selection by the player, as the choice from the plurality of player selectable elements during the bonus round comprises altering a visual indicator of the player selectable element such that an unavailability of the player selectable element is indicated to the player.

14. A system for facilitating an electronic game, comprising:

a processor; and a memory storing a program for directing the processor, the processor being operable with the program to:

(a) determine at least one outcome of a primary game;

(b) track a number of eliminator symbols won as a result of the at least one outcome of the primary game;

(c) initiate, responsive to a predetermined event occurring in the primary game, a bonus round, wherein the bonus round comprises an initial number of player selectable elements available for selection by a player of the bonus round, the number being greater than one;

(d) determine a number of eliminator symbols associated with the player upon initiation of the bonus round, the number of eliminator symbols being a sum of all eliminator symbols collected by the player since a previous bonus round;

(e) modify, based on the number of eliminator symbols associated with the player and prior to a selection of any player selectable elements by the player, the initial number of player selectable elements available for selection by the player during the bonus round by reducing the initial number by one for each eliminator symbol collected by the player during the primary game, thereby determining a final number of player selectable elements for the bonus round;

(f) output the final number of player selectable elements to the player for selection during the bonus round;

(g) determine an input from the player, the input comprising a selection of at least one player selectable element of the final number of player selectable elements; and (h) determine a result of the bonus round based on the input.

15. The system of claim 14, wherein the predetermined event comprises an occurrence of a minimum number of eliminator symbols in a given outcome of the primary game.

16. The system of claim 14, wherein processor being operable with the program to modify the initial number of player selectable elements comprises the processor being operable with the program to reduce the initial number of player selectable elements by the number of eliminator symbols.

17. The system of claim 14, wherein the processor is further operable with the program to determine, for each player selectable element, a value to be associated with the player selectable element, the value being concealed from the player at least until the player selects the at least one player selectable element.

18. The system of claim 17, wherein the processor being operable with the program to modify the initial number of player selectable elements comprises the processor being operable with the program to eliminate the player selectable element associated with a lowest value.

19. A non-transitory computer-readable medium storing instructions for directing a processor to facilitate play of a game comprising a primary game and a bonus round, the instructions causing the processor to:

(a) determine at least one outcome of the primary game;

(b) track a number of eliminator symbols won as a result of the at least one outcome of the primary game;

(c) initiate, responsive to a predetermined event occurring in the primary game, the bonus round, wherein the bonus round comprises an initial number of player selectable elements available for selection by a player of the bonus round, the initial number being greater than one;

(d) determine a number of eliminator symbols associated with the player upon initiation of the bonus round, the number of eliminator symbols being a sum of all eliminator symbols collected by the player since a previous bonus round;

(e) modify, based on the number of eliminator symbols associated with the player and prior to a selection of any player selectable elements by the player, the initial number of player selectable elements available for selection by the player during the bonus round by reducing the initial number by one for each eliminator symbol collected by the player during the primary game, thereby determining a final number of player selectable elements for the bonus round;

(f) output the final number of player selectable elements to the player for selection during the bonus round;

(g) determine an input from the player, the input comprising a selection of at least one player selectable element of the final number of player selectable elements; and (h) determine a result of the bonus round based on the input.

* * * * *